US005413902A

United States Patent [19]

Hara et al.

[11] Patent Number: 5,413,902

[45] Date of Patent: * May 9, 1995

[54] COLOR LIGHT-SENSITIVE MATERIAL

[75] Inventors: Hiroshi Hara; Takanori Hioki; Keiichi Adachi, all of Kanagawa, Japan

[73] Assignee: Fuji Photo Film Co., Ltd., Kanagawa, Japan

[ * ] Notice: The portion of the term of this patent subsequent to Oct. 13, 2009 has been disclaimed.

[21] Appl. No.: 985,227

[22] Filed: Dec. 2, 1992

Related U.S. Application Data

[63] Continuation of Ser. No. 815,871, Jan. 3, 1992, abandoned, which is a continuation of Ser. No. 486,990, Mar. 1, 1990, abandoned.

[30] Foreign Application Priority Data

Mar. 3, 1989 [JP] Japan ..... 1-51568
Mar. 13, 1989 [JP] Japan ..... 1-60526

[51] Int. Cl.[6] ..... G03C 1/46; G03C 8/10

[52] U.S. Cl. ..... 430/503; 430/202; 430/203; 430/502; 430/505; 430/508; 430/509; 430/944

[58] Field of Search ..... 430/505, 508, 383, 203, 430/202, 220, 144, 502, 503, 509, 363, 572

[56] References Cited

U.S. PATENT DOCUMENTS

| | | | |
|---|---|---|---|
| 4,250,251 | 2/1981 | Osborn et al. | 430/505 |
| 4,536,473 | 8/1985 | Mihara | 430/575 |
| 4,619,892 | 10/1986 | Simpson et al. | 430/220 |
| 4,690,883 | 9/1987 | Kubodera et al. . | |
| 5,154,995 | 10/1992 | Kawai | 430/22 |

FOREIGN PATENT DOCUMENTS

| | | |
|---|---|---|
| 0183528 | 6/1986 | European Pat. Off. . |
| 0304297 | 2/1989 | European Pat. Off. . |

OTHER PUBLICATIONS

The Theory of the Photographic Process, T. H. James 3rd edition, 1966, pp. 19–27.

*Primary Examiner*—Thorl Chea
*Attorney, Agent, or Firm*—Sughrue, Mion, Zinn, Macpeak & Seas

[57] ABSTRACT

A color light-sensitive material comprising at least three light-sensitive layers having different color-sensitivity from one another provided on a support. Each layer comprises a combination of at least a light-sensitive silver halide, a binder and a dye-providing compound. At least one layer thereof has a spectral sensitization peak in at least two wavelength regions, the peaks in the at least two wavelength regions being at least 50 nm away from each other and at least one spectral sensitization peak thereof exists in the wavelength region of 700 nm or above.

30 Claims, No Drawings

COLOR LIGHT-SENSITIVE MATERIAL

This is a continuation of application Ser. No. 07/815,871 filed Jan. 3, 1992, now abandoned, which is a continuation of application Ser. No. 07/486,990 filed Mar. 1, 1990, now abandoned.

FIELD OF THE INVENTION

This invention relates to a color light-sensitive material, and more particularly to a color light-sensitive material which may be exposed to two or more different light sources. It also relates to a transfer type heat-developable color light-sensitive material which has improved color separation and which may be exposed to at least two optical write heads and light sources.

BACKGROUND OF THE INVENTION

Silver halide color light-sensitive materials give high-quality images and are used in many fields.

The demand for color, hard copies of information on images, which is converted into electric signals, is increasing with the development of image devices for office automation, the advent of the electron steal camera, the popularization of video and facsimile machines, the development of computer graphics and image sensor, and the advance of the digital processing technique of original images.

Conventional color light-sensitive materials generally have spectral sensitivity to blue, green and red colors. Generally, color CRTs (cathode ray tubes) are used to obtain images on such color light-sensitive materials from information on images, which have been converted into electric signals. However, the CRT is unsuitable for producing large-size prints.

Light-emitting diodes (LED) or semiconductor lasers are being developed as optical write heads capable of producing large-size prints. However, an optical write head which efficiently emits blue light has not yet been developed.

For example, when a light-emitting diode is used, color light-sensitive materials having three layers spectral-sensitized (to near infrared, red and yellow colors, respectively) must be exposed to a light source composed of a near infrared (800 nm) light-emitting diode, a red (670 nm) light-emitting diode and a yellow (570 nm) light-emitting diode. Such systems for recording an image are described in *Nikkei New Material,* pages 47 to 57 (Sep. 14, 1987) and are of partial practical use.

A system for recording an image on light-sensitive materials having three light-sensitive layers having spectral sensitivity to individual wavelengths by exposure to a light source composed of three semiconductor lasers [emitting light (880 nm), light (820 nm) and light (760 nm)] is disclosed in JP-A-61-137149 (the term "JP-A" as used herein means an "unexamined published Japanese patent application").

However, color light-sensitive materials which comprise, for example, three layers of blue-sensitive, green-sensitive and red-sensitive layers conventionally used for these systems, cannot be used to reproduce an image by an optical write head such as a light-emitting diode or a semiconductor laser. Color light-sensitive materials having three light-sensitive layers spectrally sensitized to near infrared, red and yellow colors cannot be used to photograph scenery or to record visible light such as that of a conventional color CRT. Accordingly, the use thereof is limited to the reproduction of an image by separate light sources.

Further, conventional light-sensitive materials require processing solutions and a long processing time. Hence, when image is rapidly outputted from information on an image, heat-developing color light-sensitive materials are superior. Many types of heat-developing light-sensitive materials are known.

For example, methods wherein dye images are formed by a coupling reaction of couplers with the oxidation products of developing agents are described in U.S. Pat. Nos. 3,761,270 and 4,021,240. However, the methods require complicated treatments such as the removal of silver due to the formation of a color image, nor are they simple processes. Further, color reproduction deteriorates when the silver is not removed.

A method wherein a positive dye image is formed by a silver dye bleaching process is described in U.S. Pat. No. 4,235,957. This method requires complicated processing stages, since the bleaching of the dye image with silver image is carried out.

Recently, methods have been proposed wherein a diffusible dye is imagewise transferred to a dye-fixing element by heat development, (i.e. transfer type heat developable color light-sensitive materials).

In these methods, a negative dye image as well as a positive dye image can be obtained by changing the type of dye-providing compounds to be used. These methods are described in more detail in U.S. Pat. Nos. 4,500,626, 4,503,137 and 4,559,290, JP-A-58-149046, JP-A-60-133449, JP-A-59-218443, JP-A-61-238056, EP-A-220746, Kokai Giho 87-6199 and EP-A-210660. These methods will be illustrated in more detail hereinafter.

In the light-sensitive materials described in these patent specifications, the spectral sensitization of the light-sensitive silver halide of each layer has only one light-sensitivity. Namely, the light-sensitive materials are designed so that they have three respective spectral-sensitized layers to blue, green and red colors for prints from a color negative and they have three respective spectral-sensitized layers to yellow, red and near infrared colors for an LED. Accordingly, these light-sensitive materials can be used only for the reproduction of an image by using separate light sources.

SUMMARY OF THE INVENTION

An object of the present invention is to provide a color light-sensitive material which may be exposed to at least two different light sources.

Another object of the present invention is to provide a color light-sensitive material which may be exposed to at least two optical write heads and light sources and is excellent in color separation.

The above-described objects have been achieved by a color light-sensitive material comprising at least three light-sensitive layers having different color-sensitivity from one another provided on a support, each layer comprising a combination of at least a light-sensitive silver halide, a binder and a dye-providing compound, wherein at least one layer thereof has a spectral sensitization peak in at least two wavelength regions, said peaks in said at least two wavelength regions being at least 50 nm away from each other and at least one spectral sensitization peak thereof exists in the wavelength region of 700 nm or above.

DETAILED DESCRIPTION OF THE INVENTION

The present invention is illustrated in more detail below.

The color light-sensitive materials of the present invention comprise three light-sensitive layers each having a different color sensitivity from the other, each light-sensitive layer comprising a combination of light-sensitive silver halide, a binder and a dye-providing compound. The term "comprising a combination" as used herein includes embodiments wherein the light-sensitive silver halide and the dye-providing compound (with a binder) are added to the same layer as well as embodiments wherein the light-sensitive silver halide (with a binder) and the dye-providing compound (with a binder) are added to separate layers so as to allow them to be reacted with each other.

Each color-sensitive layer may be divided into two or more layers having a different sensitivity from each other.

In the present invention, at least one of these color-sensitive layers has at least two spectral sensitivities which are at least 50 nm away from each other and at least one spectral sensitization peak thereof is preset in the wavelength region of 700 nm or above.

Examples of the layer structures of the color light-sensitive materials of the present invention, include, but are not limited to, the following embodiments.

(I) Color light-sensitive materials having blue, green and red color-sensitive layers:

(a) an embodiment wherein the blue-sensitive layer also has an additional spectral sensitivity in the wavelength region of 700 nm or above;

(b) an embodiment wherein the green-sensitive layer also has an additional spectral sensitivity in the wavelength region of 700 nm or above; or (c) an embodiment wherein the red-sensitive layer also has an additional spectral sensitivity in the wavelength region of 700 nm or above.

In each of the embodiments (a), (b) and (c), the spectral sensitization peak in the wavelength region of 700 nm or above must be at least 50 nm away from the spectral sensitization peak of the red-sensitive layer.

In each of the above embodiments, it is preferred that a yellow dye-providing compound is used in the blue-sensitive layer, a magenta dye-providing compound is used in the green-sensitive layer and a cyan dye-providing compound is used in the red-sensitive layer.

When colored dye-providing compounds are used and exposure is carried out on the side of the emulsion layer, it is preferred from the viewpoint of color separation that the layer farthest from the support contains the yellow dye-providing compound and the layer nearest to the support contains the cyan dye-providing compound. When a transparent support is used and exposure is carried out on the side of the support, the reverse order to that described above is preferred.

When non-colored dye-providing compounds are used, it is preferred that a yellow filter layer is provided to prevent the green-sensitive and red-sensitive layers from being exposed to blue light.

Among the embodiments (a) (b) and (c), the embodiment (a) is particularly preferred.

(II) Color light-sensitive materials having green to yellow, red and infrared sensitive layers:

(d) an embodiment wherein the green to yellow-sensitive layer also has an additional spectral sensitivity in the wavelength region of 700 nm or above;

(e) an embodiment wherein the red-sensitive layer also has an additional spectral sensitivity in the wavelength region of 700 nm or above; or (f) an embodiment wherein the infrared-sensitive layer has two spectral sensitivities in the wavelength region of 700 nm or above.

In each of the above embodiments (d), (e) and (f), the spectral sensitization peak in the wavelength region of 700 nm or above must be at least 50 nm away from the spectral sensitization peaks of the red-sensitive layer and the original infrared-sensitive layer. In embodiment (f) the two peaks are at least 50 nm away from each other.

In each of the above embodiments (d), (e) and (f), it is preferred that a yellow dye-providing compound is used in the green to yellow sensitive layer, a magenta dye-providing compound is used in the red-sensitive layer and a cyan dye-providing compound is used in the infrared-sensitive layer. In each embodiment, it is preferred that when colored dye-providing compounds are used, an emulsion layer containing a yellow dye-providing compound is provided on the side nearest to the light source and an emulsion layer containing a cyan dye-providing compound is provided on the side farthest therefrom as in the above-mentioned embodiments (a), (b) and (c). It is preferred that a yellow filter layer is provided on the emulsion layer nearest to the light source when non-colored dye-providing compounds are used.

In embodiment (a), the blue sensitivity provided by sensitivity inherent in silver halide is insufficient because intrinsic sensitivity in the blue region is lowered by spectral sensitization in the infrared region. Hence, it is desirable to enhance spectral sensitivity in the blue region by using a sensitizing dye. Conventional dyes such as monomethine cyanine dyes and simple merocyanine dyes can be used as spectral sensitizing dyes for the blue region.

In a particularly preferred embodiment, the present invention provides a transfer type heat-developable color light-sensitive material comprising at least three light-sensitive layers having different color-sensitivity from one another provided on a support, each layer comprising a combination of at least a light-sensitive silver halide, a hydrophilic binder and a dye-providing compound, wherein at least one layer thereof has a spectral sensitization peak in at least two wavelength regions, said peaks in said at least two wavelength regions are at least 50 nm away from each other, at least one spectral sensitization peak thereof exists in the wavelength region of 700 nm or above, and a layer containing a water-insoluble dye.

In the above embodiment of the present invention, at least one layer of the color sensitive layers has at least two spectral sensitivities which are at least 50 nm away from each other and at least one spectral sensitization peak thereof is preset in the wavelength region of 700 nm or above.

It is preferred that the maximum wavelengths of the spectral sensitization peak in each layer are at least 30 nm away from each other.

Further, a layer containing a water-insoluble dye is provided in the above embodiment of the present invention for the following reason.

When spectral sensitization is carried out in the region of 700 nm or above, the breadth of the spectral sensitization is wide. Accordingly, when spectral sensitization is made at two positions in the region of 700 nm or above, it is preferably that the interval of the two spectral sensitization peaks is not less than 50 nm, more preferably about 100 nm to improve color separation. For example, that one spectral sensitization is made at 750 nm and another spectral sensitization is made at about 850 nm. However, spectral sensitization efficiency is greatly lowered and the shelf life of the light sensitive material is remarkably shortened as the wavelength of spectral sensitization becomes longer, as is well-known in the art. Accordingly, it is advantageous that the wavelength of spectral sensitization is as short as possible.

For example, when a layer B spectral-sensitized at 750 nm is provided on a layer A spectral-sensitized at 800 nm and the material is exposed to light of 750 nm, the color of the layer A is mixed at the highly exposed area ( that is, the area exposed to a larger amount of light), and color separation is insufficient. Particularly, when the layer A spectral-sensitized at 800 nm has high sensitivity, this tendency is remarkable.

Therefore, a water-insoluble dye is incorporated in the layer A or a layer between the layers A and B. The dye exhibits substantially no absorption in the vicinity of the spectral sensitization peak of the layer A and has an absorption maximum wavelength which is shorter than the spectral sensitization peak of the layer A and which exists at a position where light emitted from a light source for use in the exposure of the layer B is absorbed. In this way, spectral sensitized area on the shorter wave side of the layer A is reduced to improve color separation. Further, when dyes for use in the formation of an image are transferred, the dye for use in improving color separation is not transferred and hence color reproducibility is high, because of the above-described water-insoluble dye.

When the spectral sensitivities of two light-sensitive layers providing diffusible dyes having different hues overlap each other in the present invention, color separation and color reproducibility can be improved by incorporating a water-insoluble dye having an absorption maximum wavelength corresponding to the overlapping wavelength into the light-sensitive layer on the longer wavelength side or into a layer thereon.

The embodiment of the present invention improves color mixing caused by the overlap of the spectral sensitivities of two layers having spectral sensitization peaks in the region of 700 nm or above.

The above-described preferred embodiment of the present invention is a transfer type heat-developable light-sensitive material which contains two or more light-sensitive layers having spectral sensitization peak in the wavelength region of 700 nm or above. The spectral sensitization peaks in the region of 700 nm or above in said two or more light-sensitive layers are at least 30 nm away from one another. At least one light-sensitive layer has another spectral sensitization peak in the region of wavelength which is shorter by at least 50 nm than the spectral sensitization peak at 700 nm or above and is in the region of wavelength of 700 nm or below. A light sensitive layer (layer B) having a spectral sensitization peak in the infrared region of a shorter wavelength is positioned nearer to the intended light source than a light-sensitive layer (layer A) having spectral sensitization peak in the infrared region of a longer wavelength. And a water-insoluble dye having a maximum absorption wavelength in a wavelength region capable of absorbing light emitted from the intended light source with a spectral sensitization peak wavelength in the infrared region of the layer B, is incorporated in layer A or between layers A and B.

In this embodiment, the dye-providing compounds are non-diffusible compounds capable of forming or releasing dyes capable of diffusing in hydrophilic binders; whereas the water-insoluble dye functioning as a filter dye is not diffused when transferred, because it is insoluble in water. Accordingly, only the dye image originating from the dye-providing compound is formed.

When exposure is carried out from the side of the emulsion layer in the above-described embodiment of the present invention, it is preferred for the sake of color separation that the layer farthest from the support contains a yellow dye-providing compound (because silver halide emulsions have sensitivity to blue light). It is also preferred that the layer nearest to the support contains a cyan dye-providing compound.

When a transparent support is used and exposure is carried out from the side of the support, the reverse order to that described above is preferred. Any of the dye-providing compounds for use in the layer spectral-sensitized at two or more wavelengths may be used. However, yellow dye-providing compounds are particularly preferred, because the yellow dye-providing compounds interfere least with the spectral sensitization of the sensitizing dyes.

More specific examples of the above-described embodiment include the following materials:

(g) a transfer type heat-developable color light-sensitive material wherein three different light-sensitive layers comprise a combination of a light-sensitive layer having a green to yellow sensitivity, a red-sensitive layer and a light-sensitive layer having an infrared sensitivity; the green to yellow sensitive layer has spectral sensitization peak in the region of wavelength of 700 nm or above and the spectral sensitization peak is at least 30 nm away from the spectral sensitization peaks of the red-sensitive layer and the infrared-sensitive layer.

(h) a transfer type heat-developable color light-sensitive material wherein three different light-sensitive layers comprise a combination of a light-sensitive layer having a green to yellow sensitivity, a red-sensitive layer and a light-sensitive layer having an infrared sensitivity; and the red-sensitive layer has spectral sensitization peak in the region of wavelength of 700 nm or above and the spectral sensitization peak is at least 30 nm away from the original spectral sensitization peak of the red-sensitive layer and the spectral sensitization peak of said infrared-sensitive layer.

(i) a transfer type heat-developable color light-sensitive material wherein three different light-sensitive layers comprise a combination of a blue-sensitive layer, a green-sensitive layer and a red-sensitive layer; two layers thereof are light-sensitive layers having a spectral sensitization peak in the region of wavelength of 700 nm or above; and said two spectral sensitization peaks in the region of wavelength of 700 nm or above are at least 30 nm away from each other.

A light-sensitive material comprising: (1) a layer containing a yellow dye-providing compound which is spectral-sensitized to blue light, (2) a layer containing a magenta dye-providing compound which is spectral-sensitized to green light, (3) a layer containing a cyan dye-providing compound which is spectral-sensitized to red light, and (4) an infrared sensitizing dye of at least 700 nm according to the present invention which is added to the layer containing the yellow dye-providing compound, may be used in the following methods:

By using blue, green and red spectral sensitizations (1) one wherein scenery or persons are photographed directly by cameras, (2) one wherein exposure is carried out through reversal films or negative films by printers or enlargers, (3) one wherein the original image is subjected to scanning exposure, through slits, by the exposure devices of copying machines, and (4) one wherein information on images is outputted to an image display device such as a CRT, a liquid crystal display, an electroluminescence display or a plasma display and exposure is conducted directly or through an optical system.

Further, by using the same light-sensitive material, and green, red and infrared spectral sensitizations, information on images can be recorded through electric signals from green, red and infrared light-emitting diode light sources.

Specifically, the light-sensitive material makes it possible for one light-sensitive material to be applied to two uses.

Another example is a light-sensitive material comprising a layer containing a yellow dye-providing compound which is spectrally sensitized to yellow light, a layer containing a magenta dye-providing compound which is spectral-sensitized to red light, a layer containing a cyan dye-providing compound which is spectral-sensitized to near infrared of 810 nm and an infrared sensitizing dye of 750 nm which is added to the layer containing a yellow dye-providing compound.

When spectral sensitization of yellow, red and 810 nm are used, an image is recorded through electric signals by using light-emitting diodes. When spectral sensitization of red, 750 nm and 810 nm are used, an image is recorded through electric signals by using a semiconductor laser in addition thereto, various combinations can be used.

Examples of the above-described information on images include image signals obtained from video cameras, electron steal cameras, etc., television signals according to Nippon Television Signal Code (NTSC), image signals obtained by dividing the original image into many dots by means of a scanner, and image signals obtained from computers such as CG, CAD, etc.

Examples of light-emitting diodes which are used as light sources in the present invention include GaAsP (red), GaP (red, green), GaAsP:N (red, yellow), GaAs (infrared), GaAlAs (infrared, red), GaP:N (red, green, yellow), GaAs:Si (infrared), GaN (blue), SiC (blue), etc.

Infrared-visible light transduction elements can be used to convert infrared light from the above-described infrared light-emitting diodes into visible light by phosphors. Preferred examples of the phosphors include phosphors activated with rare earth elements. Examples of the rare earth elements include $Er^{3+}$, $Tm^{3+}$, $Yb^{3+}$, etc Examples of semiconductor lasers include those obtained by using $In_{1-x}Ga_xP$ (~700 nm), $GaAs_{1-x}P_x$ (610~900 nm), $Ga_{1-x}Al_xAs$ (690~900 nm), InGaAsP (1100~1670 nm), AlGaAsSb (1250~1400 nm) or the like as the light-emitting material. The irradiation of the color light-sensitive material with light may be carried out with YAG laser (1064 nm) obtained by exciting an Nd:YAG crystal with $GaAs_xP_{(1-x)}$ light-emitting diode.

The second high frequency generating element (SHG element) in the present invention can reduce the wavelength of a laser beam by ½ by applying a non-linear optical effect. Examples of non-linear optical crystals include those using CD*A and KD*P (see, *Laser Handbook,* pages 122–139, edited by Laser Society, Dec. 15, 1982). A $LiNbO_3$ light waveguide element can be used wherein the $Li^+$ in the $LiNbO_3$ crystal is ion-exchanged with $H^+$ to form light waveguide [see, *NIKKEI ELECTRONICS,* page 89–90, Jul. 14, 1986 (no. 399)].

The silver halide of the present invention may be silver chloride, silver bromide, silver iodobromide, silver chlorobromide, silver chloroiodide and/or silver chloroiodobromide.

The silver halide emulsion of the present invention may be a surface latent image type emulsion or an internal latent image type emulsion. The internal latent image type emulsion may be used as a direct-reversal emulsion in combination with a nucleating agent or a light fogging process. Alternatively, the silver halide emulsion may be a core/shell emulsion in which the interior and the surface of the grain are different from each other in phase. The silver halide emulsion may be a monodisperse or polydisperse emulsion or a mixture of the monodisperse emulsions. The grain size of the emulsion is preferably in the range of from 0.1 to 2 μm, particularly from 0.2 to 1.5 μm. The crystal form of the silver halide grains may be cubic, octahedral, tetradecahedral or tabular with a high aspect ratio.

In particular, silver halide emulsions described in U.S. Pat. No. 4,500,626, column 50 and U.S. Pat. No. 4,628,021, *Research Disclosure,* No. 17029 (June, 1978), and JP-A-62-253159 may be used in the present invention.

The silver halide emulsion may be unripened but is normally has been chemically sensitized. The emulsions for the light-sensitive materials may be subjected to known sulfur sensitization processes, reduction sensitization processes and noble metal sensitization processes, either singly or in combination. Optionally these chemical sensitization processes may be effected in the presence of a nitrogen-containing heterocyclic compound disclosed in JP-A-62-253159.

The amount of the light-sensitive silver halide emulsion coated on the support is in the range of 1 mg to 10 $g/m^2$ (calculated in terms of the amount of silver).

Examples of the sensitizing dyes, having a spectral sensitization peak in the region of wavelength of 700 nm or above when added to the silver halide used for the color light-sensitive materials of the present invention, include, but are not limited to, compounds represented by the following formulae (I), (II) and (III):

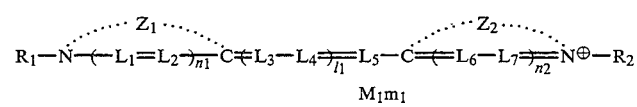

(I)

-continued

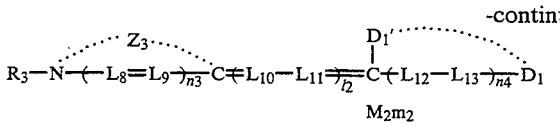

(II)

$M_2m_2$

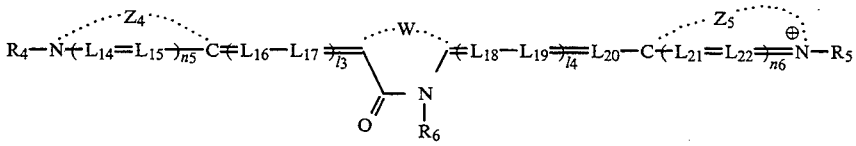

(III)

$M_3m_3$

In the above formulae, $Z_1$, $Z_2$, $Z_3$, $Z_4$ and $Z_5$ each represents an atomic group required for the formation of a 5-membered or 6-membered nitrogen-containing heterocyclic ring.

$D_1$ and $D_1'$ each represents an atomic group required for the formation of an acidic nucleus which may be acyclic or cyclic.

W represents an atomic group required for the formation of a 5-membered or 6-membered nitrogen-containing heterocyclic ring.

$R_1$, $R_2$, $R_3$, $R_4$ and $R_5$ represent each an alkyl group.

$R_6$ represents an alkyl group, an aryl group or a heterocyclic group.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$ and $L_{22}$ each represents a methine group.

$n_1$, $n_2$, $n_3$, $n_4$, $n_5$ and $n_6$ each represents 0 or 1.

$l_1$ represents 1, 2 or 3 with the proviso that when $l_1$ is 1, $Z_1$ and $Z_2$ are each a 4-quinoline nucleus or a 4-pyridine nucleus. Further, when $l_1$ is 2, at least one of $Z_1$ and $Z_2$ is a 4-quinoline nucleus or a 4-pyridine nucleus.

$l_2$ represents 2 or 3. When $l_2$ is 2, $Z_3$ is a 4-quinoline nucleus or a 4-pyridine nucleus.

$l_3$ represents 1, 2 or 3; $l_4$ represents 0, 1 or 2; and $l_3+l_4$ is 2 or greater.

$M_1$, $M_2$ and $M_3$ each represents a counter ion for balancing electric charge, and $m_1$, $m_2$ and $m_3$ each is a number of not smaller than 0 necessary to for balance electric charge. The counter ion may be a metal or an organic compound.

Examples of nuclei formed by $Z_1$, $Z_2$, $Z_3$, $Z_4$ and $Z_5$ include: thiazole nuclei, such as thiazole nuclei (e.g., thiazole, 4-methylthiazole, 4-phenylthiazole, 4,5-dimethylthiazole, 4,5-diphenyithiazole), benzthiazole nuclei (e.g., benzthiazole, 4-chlorobenzthiazole, 5-chlorobenzthiazole, 6-chlorobenzthiazole, 5-nitrobenzthiazole, 4-methylbenzthiazole, 5-methylbenzthiazole, 6-methylbenzthiazole, 5-bromobenzthiazole, 6-bromobenzthiazole, 5-iodobenzthiazole, 5-enylbenzthiazole, 5-methoxybenzthiazole, 6-methoxyzthiazole, 5-ethoxybenzthiazole, 5-ethoxycarbonylenzthiazole, 5-carboxybenzthiazole, 5-phenethylbenzthiazole, 5-fluorobenzthiazole, 5-chloro-6-methylbenzthiazole, 5,6-dimethylbenzthiazole, 5,6-dimethoxybenzthiazole, 5-hydroxy-6-methylbenzthiazole, tetrahydrobenzthiazole, 4-phenylbenzthiazole), and naphthothiazole nuclei (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3d]thiazole); thiazoline nuclei (e.g., thiazoline, 4-methylthiazoline, 4-nitrothiazoline); oxazole nuclei such as oxazole nuclei (e.g., oxazole, 4-methyloxazole, 4-nitrooxazole, 5-methyloxazole, 4-phenyloxazole, 4,5-diphenyloxazole, 4-ethyloxazole), benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobnzoxazole, 6-methoxybenzoxazole, 6-hydroxybenzoxazole, 5,6-dimethylbenzoxazole, 4,6-dimethylbenzoxazole, 5-ethoxybenzoxazole), and naphthoxazole nuclei (e.g., naphtho[2,1-d]oxazole, naphtho[1,2-d]oxazole, naphtho[2,3-d]oxazole, 5-nitronaphtho[2,1-d] oxazole; oxazoline nuclei (e.g., 4,4-dimethyloxazoline); selenazole nuclei, such as selenazole nuclei (e.g., 4-methylselenazole, 4-nitroselenazole, 4-phenylselenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), and naphthoselenazole nuclei (e.g., naphtho[2,1-d]selenazole, naphtho[1,2-d]selenazole); selenazoline nuclei (e.g., selenazoline, 4-methylselenazoline); tellurazole nuclei, such as tellurazole nuclei (e.g., tellurazole, 4-methyltellurazole, 4-phenyltellurazole), benztellurazole nuclei (e.g., benztellurazole, 5-chlorobenztellurazole, 5-methylbenztellurazole, 5,6-dimethylbenztellurazole, 6-methoxybenztellurazole) and naphthotellurazole nuclei (e.g., naphtho[2,1-d]tellurazole, naphtho[1,2-d]tellurazole); tellurazoline nuclei (e.g., tellurazoline, 4-methyltellurazoline); 3,3-dialkylindolenine nuclei (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5-chloroindolenine); imidazole nuclei, such as imidazole nuclei (e.g., 1-alkylimidazole, 1-alkyl-4-phenylimidazole, 1-arylimidazole), benzimidazole nuclei (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-aryl-benzimidazole, 1-aryl-5-chlorobenzimidazole, 1-aryl-5,6-dichlorobenzimidazole, 1-aryl-5-methoxybenzimidazole, 1-aryl-5-cyanobenzimidazole) and naphthoimidazole nuclei (e.g., 1-alkylnaphtho[1,2-d]imidazole, 1-arylnaphtho[1,2-d]imidazole,) (preferred examples of the above-described alkyl groups being those having 1 to 8 carbon atoms including unsaturated alkyl groups such as methyl, ethyl, propyl, isopropyl and butyl and hydroxyalkyl groups such as 2-hydroxyethyl and 3-hydroxypropyl with methyl and ethyl being particularly preferred; and examples of the above-described aryl group being phenyl, halogen (e.g., chloro)-substituted phenyl, alkyl (e.g., methyl)substituted phenyl and alkoxy (e.g., methoxy)substituted phenyl); pyridine nuclei (e.g., 2-pyridine, 4-pyridine, 5-methyl-2-pyridine, 3-methyl-4-pyridine); quinoline nuclei, such as quinoline nuclei (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), and isoquinoline nuclei (e.g., 6-nitro-1-isoquinoline, 3,4-dihydro-1-quinoline, 6-nitro-3-isoquinoline); imidazo[4,5-d]quinoxaline nuclei (e.g., 1,3-diethylimidazo[4,5-d]quinoxaline, 6-chloro-1,3-diallylimidazo[4,5-d]quinoxaline); oxadiazole nuclei; thiadiazole nuclei; tetrazole nuclei; and pyrimidine nuclei.

Among them, the benzthiazole nucleus, naphthothiazole nucleus, benzoxazole nucleus, naphthoxazole nucleus, 4-quinoline nucleus and benzimidazole nucleus are preferred.

$D_1$ and $D'_1$ each is an atomic group required for the formation of an acidic nucleus, which may be any of the acidic nuclei of conventional merocyanine dyes. Preferably, $D_1$ is cyano, sulfo or carbonyl group and $D'_1$ is an atomic group required for the formation of the remainder of an acidic nucleus.

When the acidic nucleus is acyclic, that is, when $D_1$ and $D'_1$ each is an independent group, the terminal of methine bond is a group such as malononitrile, alkylsulfonylacetonitrile, cyanomethylbenzofuranylketone or cyanomethylphenylketone.

$D_1$ and $D'_1$ may be combined together to form a 5-membered or 6-membered ring comprising carbon, nitrogen and/or chalcogen (typically, oxygen, sulfur, selenium and tellurium) atoms. Preferred examples of nuclei formed by $D_1$ and $D'_1$ when they are combined include 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazolidine-2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, indazoline-3-one, 2-oxoindazolium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one and pyrido[1,2-a]pyrimidine-1,3-dione.

A 3-alkylrhodanine nucleus, a 3-alkyl-2-thiohydantoin nucleus and a 3-alkyl-2-thioxazolidine-2,4-dione nucleus are more preferred.

The nitrogen atom in these nuclei may be substituted. Preferred examples of the substituent groups include a hydrogen atom, an alkyl group having from 1 to 18 carbon atoms, preferably 1 to 7 carbon atoms, more preferably 1 to 4 carbon atoms (e.g., methyl, ethyl, propyl, isopropyl, butyl, isobutyl, hexyl, octyl, dodecyl, octadecyl), a substituted alkyl group [such as an aralkyl group (e.g., benzyl, 2-phenylethyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfatoalkyl group (e.g., sulfatopropyl, 4-sulfatobutyl), a heterocyclic ring-substituted alkyl group (e.g., 2-(pyrrolidine-2-one-1-yl)ethyl, tetrahydrofurfuryl, 2-morpholinoethyl), 2-acetoxyethyl group, carbomethoxymethyl group and 2-methanesulfonylaminoethyl], an allyl group, an aryl group (e.g., phenyl, 2-naphthyl), a substituted aryl group (e.g., 4-carboxyphenyl, 4-sulfophenyl, 3-chlorophenyl, 3-methylphenyl), and a heterocyclic group (e.g., 2-pyridyl, 2-thiazolyl).

Among these substituents, an unsubstituted alkyl group (e.g., methyl, ethyl, propyl) and a carboxyalkyl group (e.g., carboxymethyl, 2-carboxyethyl) are more preferred.

Examples of the nitrogen-containing heterocyclic rings formed by W include 1,3-tiazolidine ring.

Preferably, $R_1$, $R_2$, $R_3$, $R_4$ and $R_5$ each is an unsubstituted alkyl group having not more than 18 carbon atoms (e.g., methyl, ethyl, propyl, butyl, pentyl, octyl, decyl, dodecyl, octadecyl) or a substituted alkyl group [an alkyl group having not more than 18 carbon atoms, substituted by one or more carboxy group, sulfo group, cyano group, halogen (e.g., fluorine, chlorine, bromine), hydroxyl group, an alkoxycarbonyl group having not more than 8 carbon atoms (e.g., methoxycarbonyl, ethoxycarbonyl, phenoxycarbonyl, benzyloxycarbonyl), an alkoxy group having not more than 8 carbon atoms (e.g., methoxy, ethoxy, benzyloxy, phenethyloxy), a monocyclic aryloxy group having not more than 10 carbon atoms (e.g., phenoxy, p-tolyloxy), an acyloxy group having not more than 3 carbon atoms (e.g., acetyloxy, propionyloxy), an acyl group having not more than 8 carbon atoms (e.g., acetyl, propionyl, benzoyl, mesyl), a carbamoyl group (e.g., carbamoyl, N,N-dimethylcarbamoyl, morpholinocarbamoyl, piperidinocarbonyl), a sulfamoyl group (e.g., sulfamoyl, N,N-dimethylsulfamoyl, morpholinosulfonyl, piperidinosulfonyl), an aryl group having not more than 10 carbon atoms (e.g., phenyl, 4-chlorophenyl, 4-methylphenyl, α-naphthyl)].

Among these $R_1$ to $R_5$ groups, an unsubstituted alkyl group (e.g., methyl, ethyl, pentyl), a sulfoalkyl group (e.g., 2-sulfoethyl, 3-sulfopropyl, 4-sulfobutyl) and a carboxyalkyl group (e.g., carboxymethyl, 2-carboxyethyl) are more preferred.

Particularly preferred metal atoms capable of forming a salt with $R_1$, $R_2$, $R_3$, $R_4$ or $R_5$ are alkali metals such as sodium and potassium. Preferred organic compounds capable of forming a salt are pyridines and amines.

Preferred examples of $R_6$ are the nitrogen atom substituents described above.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$m $L_{17}$, $L_{18}$, $L_{19}$, $L_{20}$, $L_{21}$ and $L_{22}$ each is a methine group which may be optionally substituted by one or more of a substituted or unsubstituted alkyl group (e.g., methyl, ethyl, 2-carboxyethyl), a substituted or unsubstituted aryl group (e.g., phenyl, o-carboxyphenyl), halogen (e.g., chlorine, bromine), an alkoxy group (e.g., methoxy, ethoxy) or an alkylthio group (e.g., methylthio, ethylthio). The methine group may be combined together with another methine group or auxochrome to form a ring.

$M_1m_1$, $M_2m_2$ and $M_3m_3$ each is included in the formulae to show the presence or absence of a cation or an anion when required to neutralize the ion charge of the dye. Whether a dye is a cation or an anion, or has net ion charge varies depending on auxochrome and substituent groups.

Typical examples of cations are ammonium ion and alkali metal ions. Anions may be any inorganic anion and organic anion. Examples of the anions include halogen anion (e.g., fluorine ion, chlorine ion, bromine ion, iodide ion), substituted arylsulfonate ion (e.g., p-toluenesulfonate ion, p-chlorobenzenesulfonate ion), arylsulfonate ion (e.g., 1,3-benzenedisulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion.

Among these ions, an iodine ion is preferred.

Examples of the dyes which can be used in the present invention include, but are not limited to, the following compounds:

(I-1)

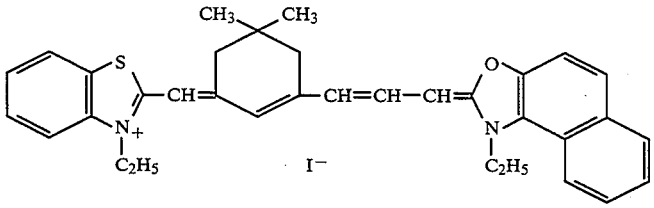

(I-2)

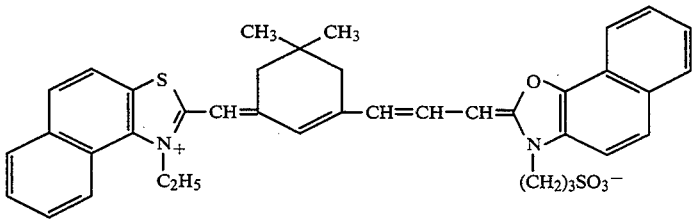

(I-3)

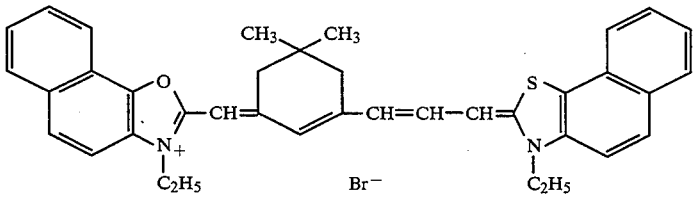

(I-4)

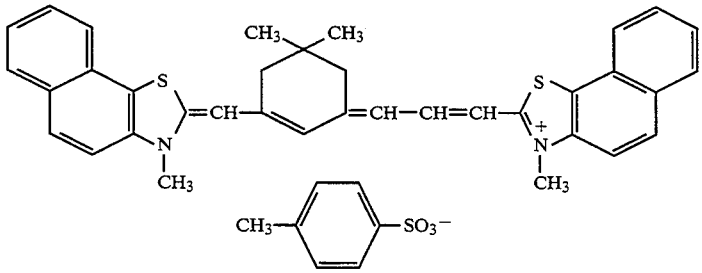

(I-5)

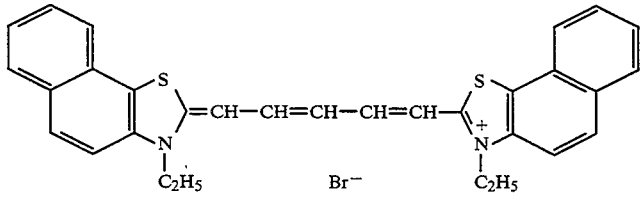

(I-6)

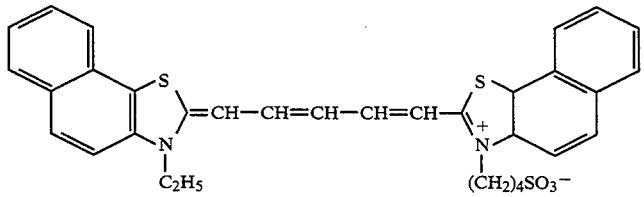

-continued
(I-7)
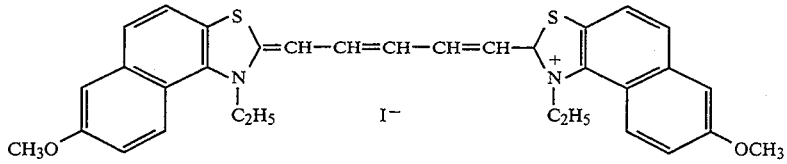
(I-8)
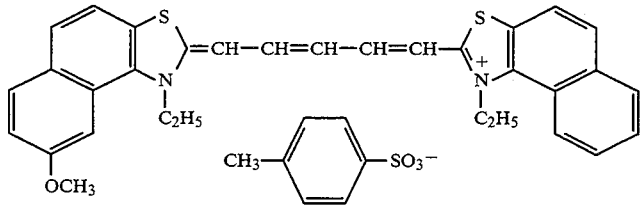
(I-9)
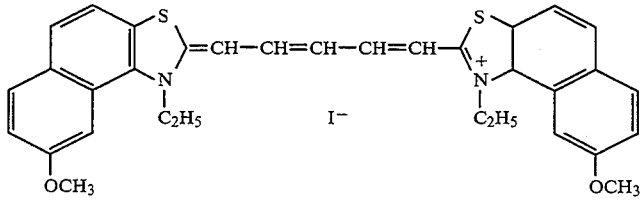
(I-10)
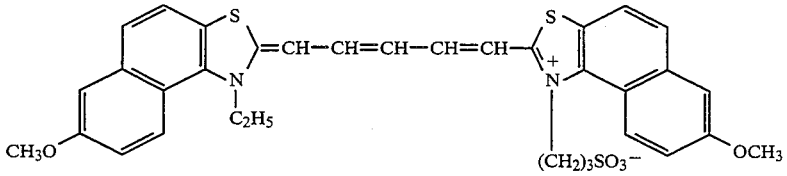
(I-11)
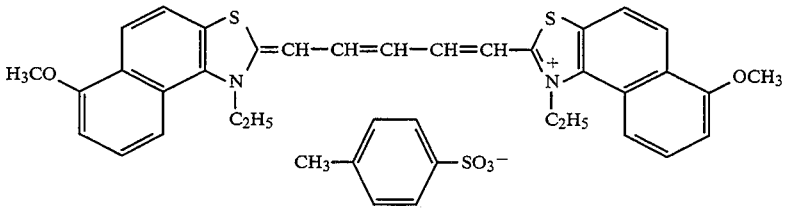
(I-12)
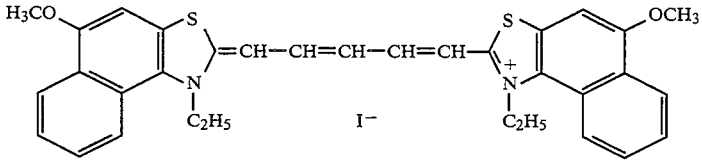
(I-13)
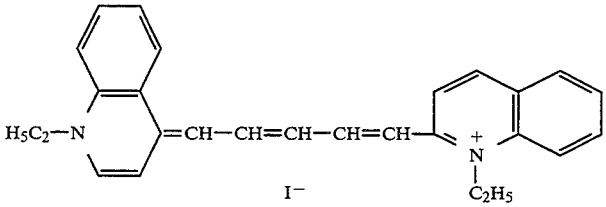
(I-14)
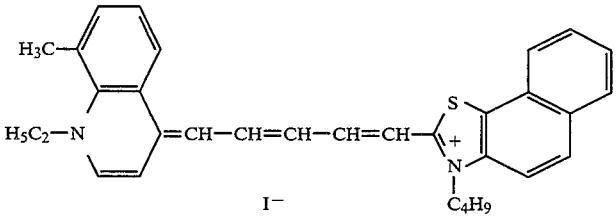

-continued
(I-15)
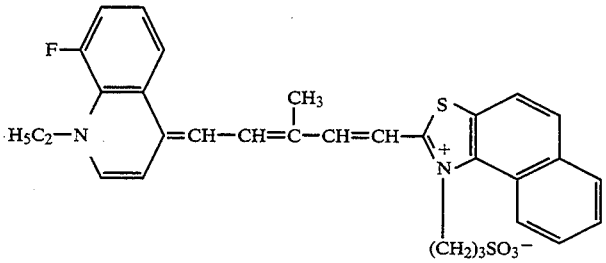
(I-16)
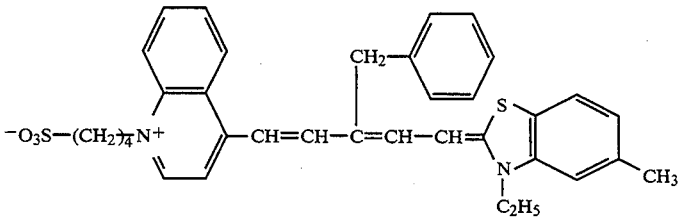
(I-17)
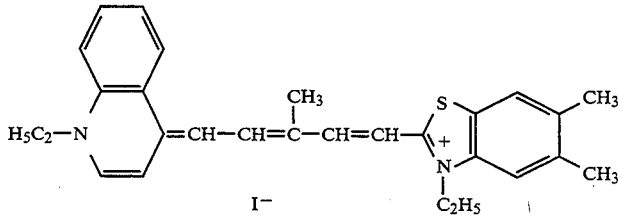
(I-18)
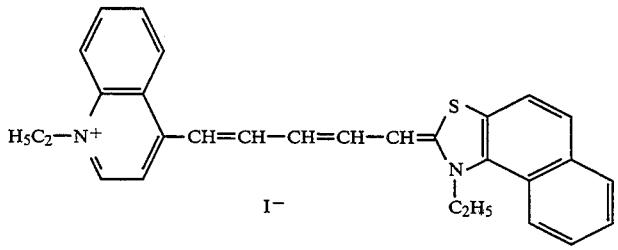
(I-19)
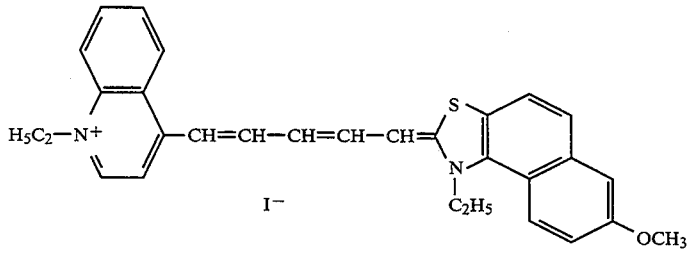
(I-20)
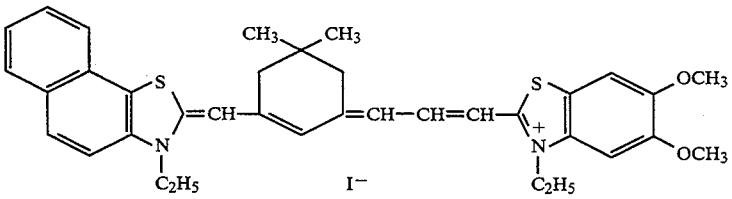
(I-21)
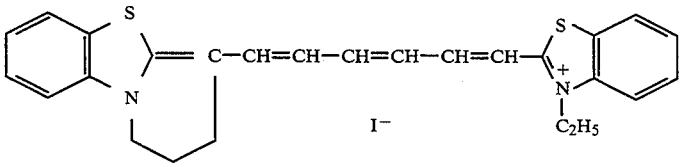

-continued
(I-22)
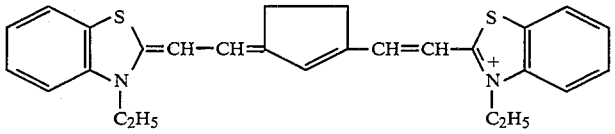
(I-23)
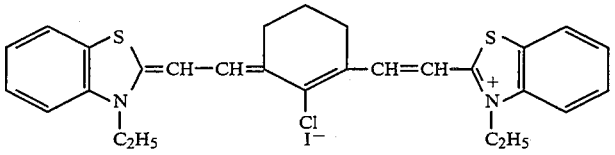
(I-24)
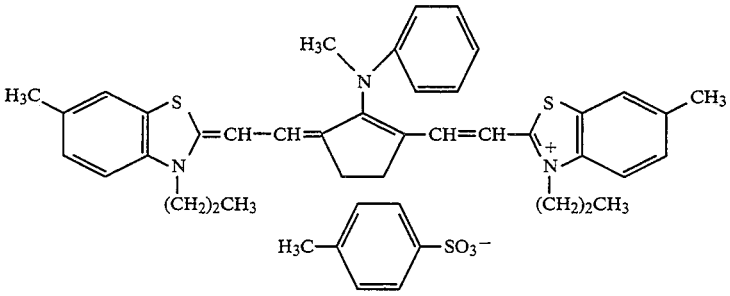
(I-25)
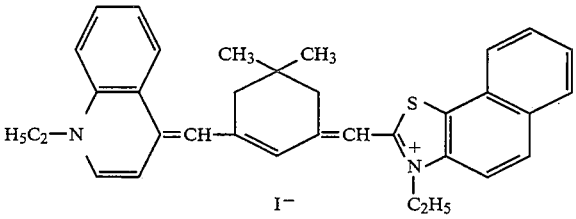
(I-26)
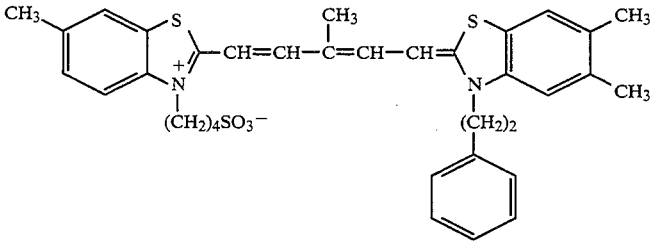
(I-27)
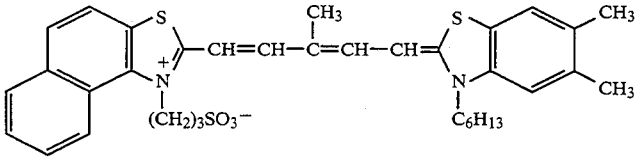
(II-1)
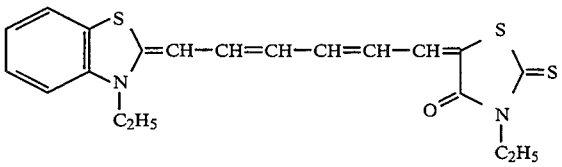

-continued
(II-2)
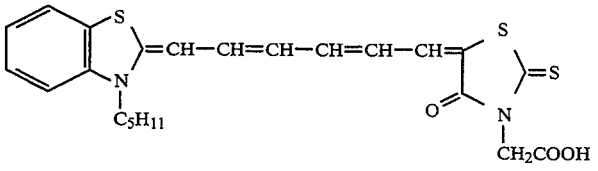
(II-3)
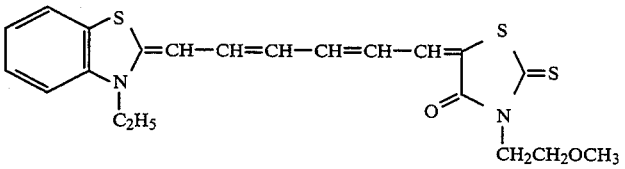
(II-4)
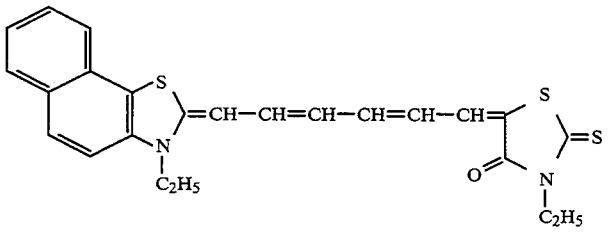
(II-5)
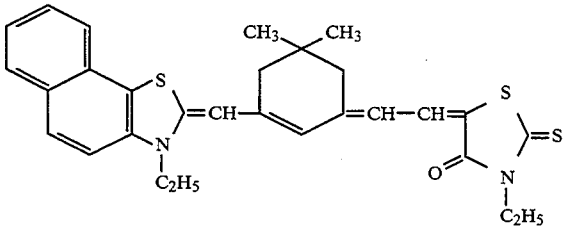
(II-6)
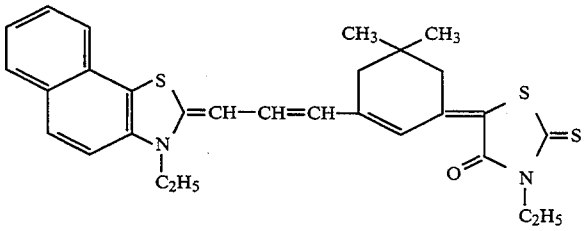
(II-7)
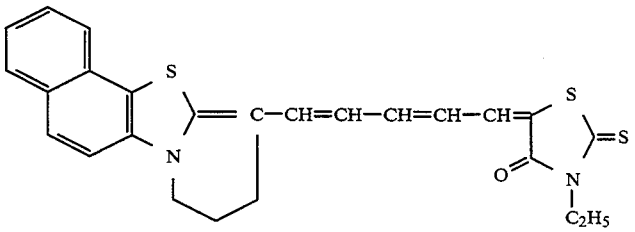
(II-8)
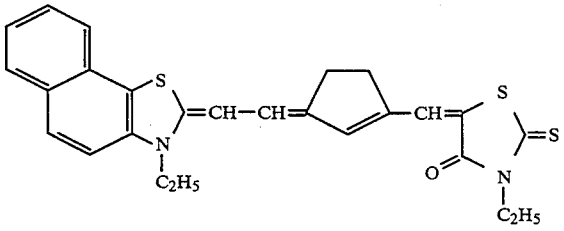

-continued (II-9)

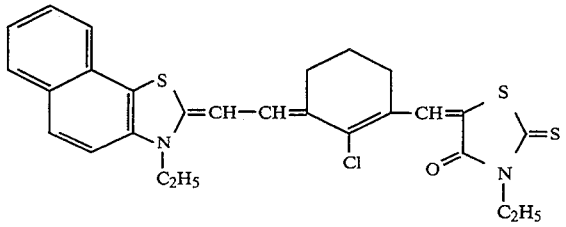

(II-10)

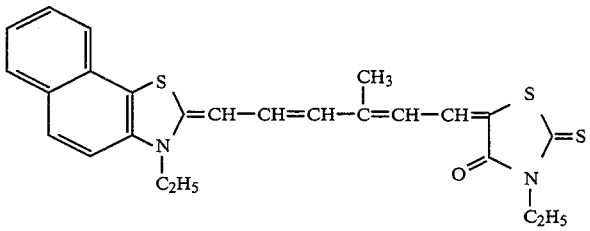

(III-1)

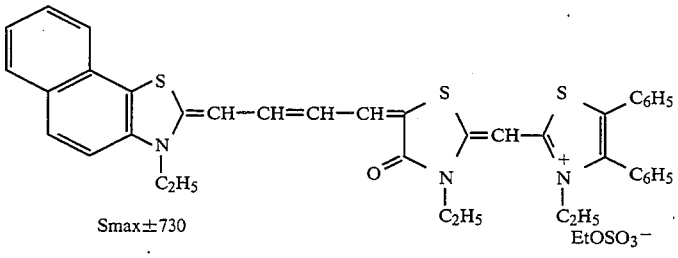

Smax±730

(III-2)

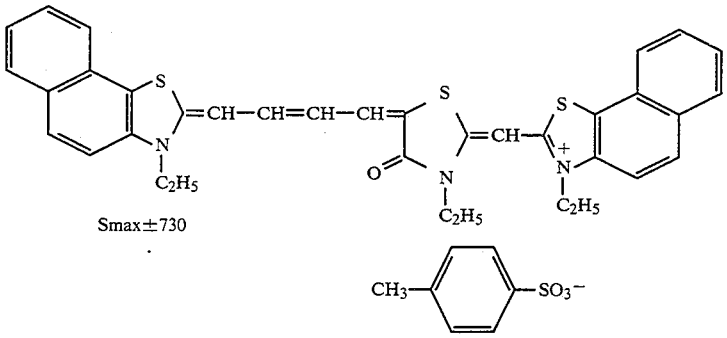

Smax±730

The compounds of the formulae (I), (II) and (III) of the present invention are known compounds and can be prepared according to the methods described in the following literature references (1), (2) and (3):

(1) Heterocyclic Compounds-Cyanine Dye and Related Compounds
Chapters IV, V, VI, VII, VIII and IX, pages 86–291
Chapter XIV, pages 511–611
Chapter XV, pages 612–684
(John Wiley & Sons, New York, London, 1964);

(2) Heterocyclic Compounds-Special Topics in Heterocyclic Chemistry, written by D. M. Stumer
Chapter 8, Paragraph 4, pages 482–515
(John Wiley & Sons, New York, London, 1977); and (3) Rodd's Chemistry of Carbon Compounds, written by D. J. Fry
2nd Ed. Vol. IV, Part B, 1977
Chapter 15, pages 369–422
(2nd Ed. Vol. IV, Part B, 1985)
Chapter 15, pages 267–296
(Elsvier Science Publishing Company Inc., New York).

The silver halide of the present invention is spectral-sensitized with, in addition to the above-described dyes used for sensitization in the region of wavelength of 700 nm or above, methine dyes or the like as the sensitizing dyes used in the region of the other wavelength. Examples of such sensitizing dyes include conventional dyes such as cyanine dyes, merocyanine dyes, complex cyanine dyes, complex merocyanine dyes, holopolar cyanine dyes, hemicyanine dyes, styryl dyes and hemioxonol dyes.

Specific examples of the sensitizing dyes include those described in U.S. Pat. No. 4,617,257, JP-A-59-180550, JP-A-60-140335 and *Research Disclosure* (hereinafter referred to as RD) 17029 (June, 1978), pages 12 and 13.

These sensitizing dyes may be used either alone or a combination. The combinations of the sensitizing dyes are often used for the purpose of supersensitization.

Emulsions may contain a dye which itself does not have a spectral sensitization effect, but exhibits supersensitization activity in addition to the sensitizing dye or a compound which does substantially not absorb visible light, but exhibits supersensitization activity in addition to the sensitizing dye (e.g., those described in U.S. Pat. No. 3,615,641 and JP-A-63-23145).

These sensitizing dyes may be added to the emulsion during, before or after chemical sensitization. The sensitizing dyes may be added to the emulsion before or after the nucleation of silver halide grains as described in U.S. Pat. Nos. 4,183,756 and 4,225,666. They may be added together with other additives before coating. The sensitizing dyes are generally used in an amount of $10^{-8}$ to $10^{-2}$ mol per mol of silver halide.

The color light-sensitive materials of the present invention can be formulated as color light-sensitive materials wherein couplers are employed as dye-providing compounds, which materials are subjected to a wet process. The couplers, the other additives and the methods of wet process for use in these systems are known and described in JP-A-62-215272.

The color light-sensitive materials of the present invention can be formulated as color diffusion transfer light-sensitive materials which are subjected to a wet process. These systems are known and described in JP-B-46-16356 (the term "JP-B" as used herein means an examined Japanese patent publication), JP-B-48-33697, JP-A-50-13040, JP-A-57-119345 and JP-A-63-226649.

The color light-sensitive materials of the present invention can be formulated as light-sensitive materials for silver dye bleaching as described in *The Theory of the Photographic Process,* fourth edition (written by T. H. James, Macmillan, New York, 1977) pages 363–366.

It is particularly preferred from the viewpoint of simplicity of processing to form an image that the present invention is applied to heat developable color light-sensitive materials. In the description below, additives and methods of process used in the case where the present invention is applied to the heat-developable color light-sensitive materials are described in detail. In the description below, an element containing silver halide, a binder and a dye-providing compound is referred to as a light-sensitive element, and an element for receiving an image of a diffusible dye released from the light-sensitive element is referred to as a dye-fixing element. Together, they are referred to as a heat-developable color light-sensitive material.

The water-insoluble dyes which are used in the particularly preferred embodiment of the present invention are chosen from among cyanine dyes, merocyanine dyes, hemicyanine dyes, styryl dyes, oxonol dyes, azomethine dyes and indophenol.

Examples of the water-insoluble dyes which can be used in the present invention include, but are not limited to, the following compounds:

S-1

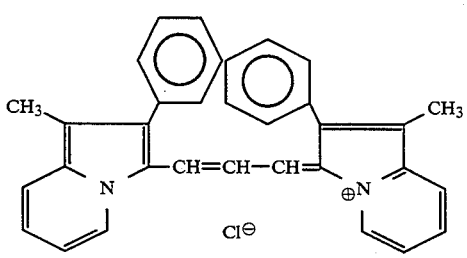

S-2

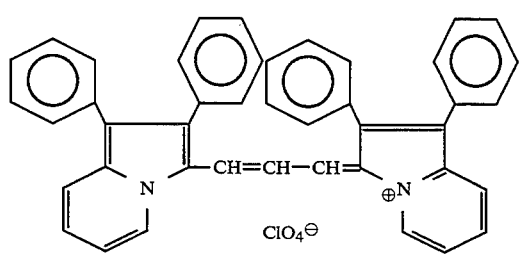

S-3

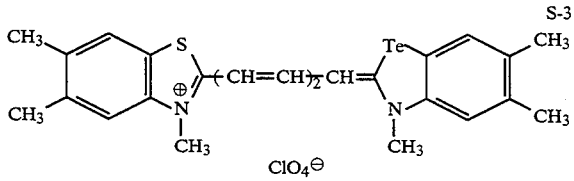

S-4

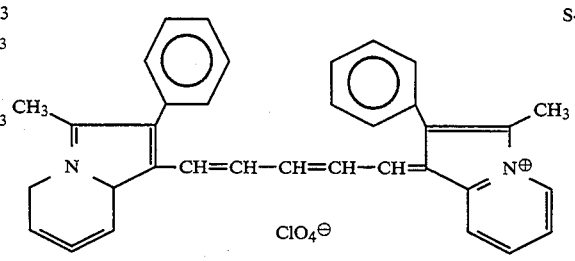

S-5

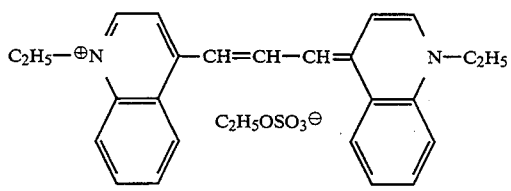

S-6

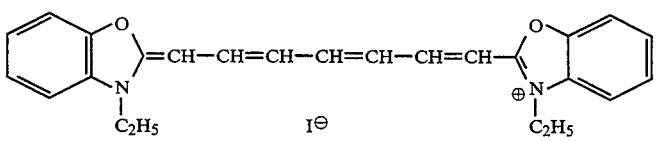

-continued
S-7
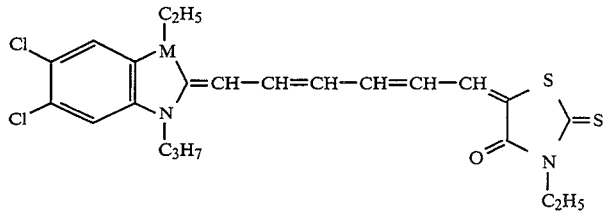
S-8
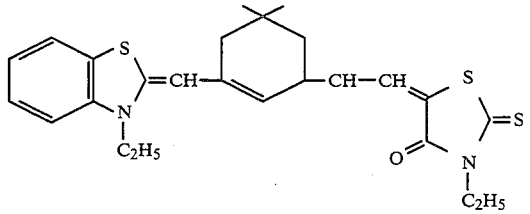
S-9
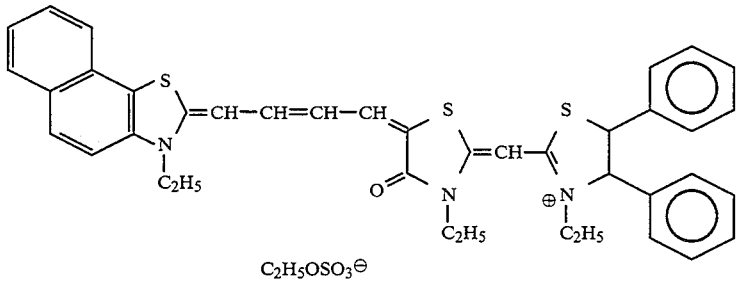
S-10
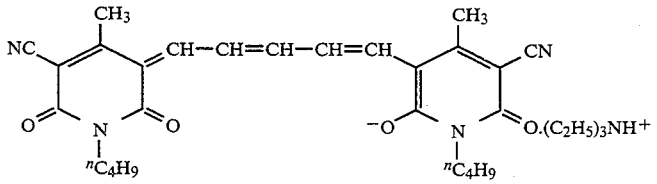
S-11
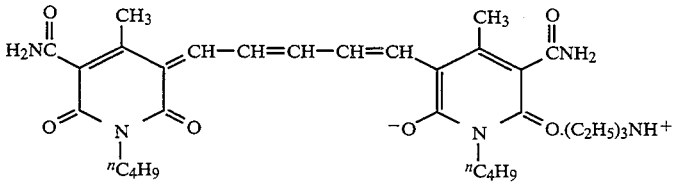
S-12
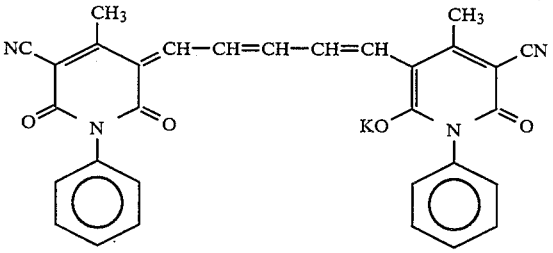
S-13
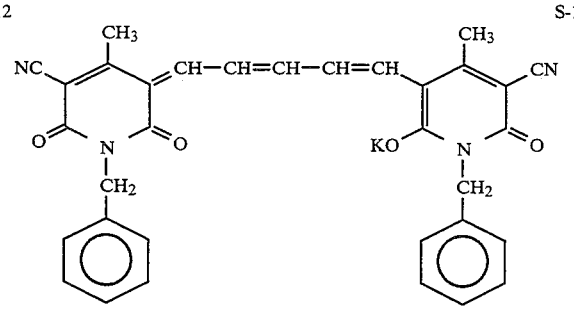
S-14
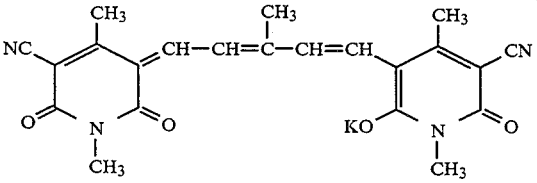
S-15
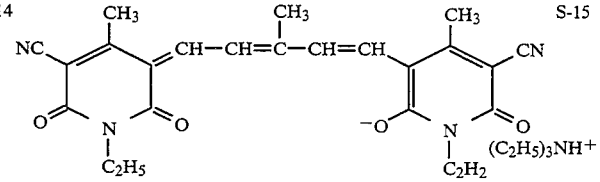

-continued

S-16

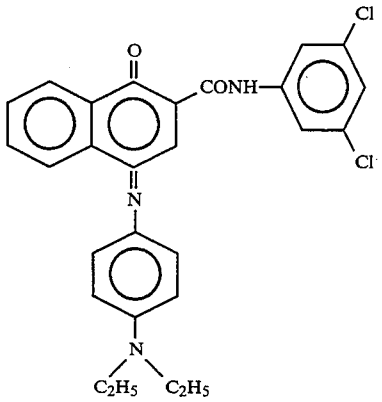

S-17

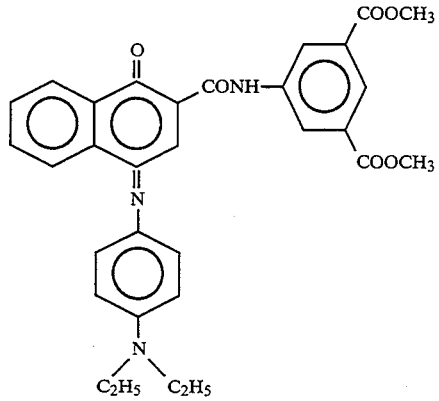

S-18

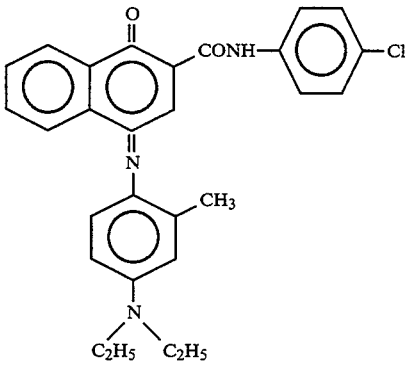

S-19

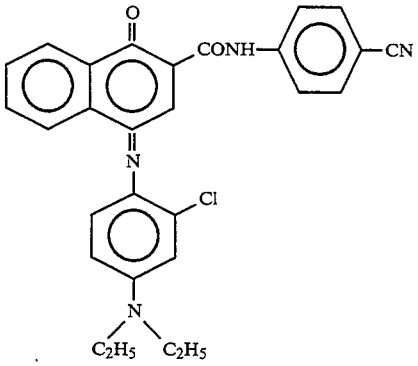

S-20

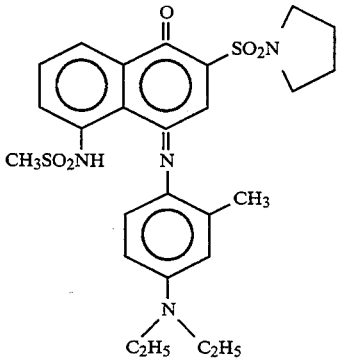

S-21

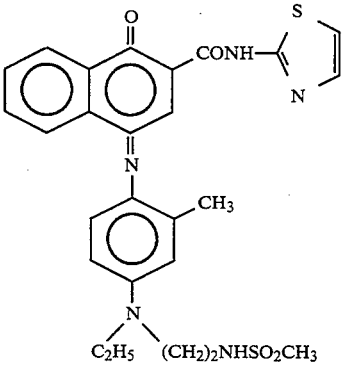

S-22

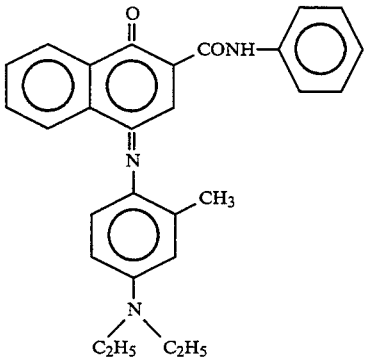

The dyes of the present invention can be easily synthesized according to the methods described in U.S. Pat. Nos. 3,260,601 and 3,335,010, U.K. Patents 789,077, 658,560, 1,521,083, 1,579,899 and 390,093.

The transfer type heat-developable color light-sensitive materials of the present invention may include various auxiliary layers such as a protective layer, a subbing layer, an interlayer, a yellow filter layer, an antihalation layer, a backing layer, etc.

When the material of the present invention is a transfer type heat-developable color light-sensitive material for transferring a dye released from a light-sensitive element by heat development to an image-receiving element, the material containing silver halide emulsions, dye-providing compounds, etc. is referred to as a light-sensitive element and the material for receiving an image is referred to as a dye-fixing element. Both are sometimes referred to as a transfer type heat-developable color light-sensitive material.

In this invention, organic metal salts can be used as oxidizing agent together with light-sensitive silver halides. Of organic metal salts, organic silver salts are particularly preferred as such an oxidizing agent.

As examples of organic compounds which can be used for forming the above-described organic silver salts to function as oxidizing agent, mention may be made of benzotriazoles described, e.g., in U.S. Pat. No. 4,500,626, columns 52 to 53, fatty acids and so on. In addition, silver salts of carboxylic acid having an alkynyl group, such as silver phenylpropiolate disclosed in JP-A-60-113235, and acetylene silver disclosed in JP-A-61-249044 are also useful. Organic silver salts as described above may be used in combination of two or more thereof.

The organic silver salt can be used in an amount of 0.01 to 10 moles, preferably 0.01 to 1 mole, per mole of the light-sensitive silver halide. It is appropriate that a coverage of the light-sensitive silver halide and that of the organic silver salt should amount to from 50 mg/m$^2$ to 10 g/m$^2$ in all, based on the silver.

Conventional antifogging agents or photographic stabilizers can also be used in this invention. Suitable examples of such agents, mention may be made of the azoles and the azaindenes described in RD-17643, pages 24 to 25 (December, 1978), the nitrogen-containing carboxylic acids and phosphoric acids disclosed in JP-A-59-168442, the mercapto compounds and the metal salts thereof disclosed in JP-A-59-111636, the acetylene compounds disclosed in JP-A-62-87957, and so on.

Binders which can be preferably used in constituent layers of the light-sensitive element and the dye-fixing element are hydrophilic ones. As examples of hydrophilic binders, mention may be made of those described in JP-A-62-253159, pages 26 to 28. More specifically, transparent or translucent hydrophilic binders, e.g., natural compounds such as proteins including gelation and gelatin derivatives, cellulose derivatives, and polysaccharides including starch, gum arabic, dextran, pullulan and the like; and synthetic high molecular compounds such as polyvinyl alcohol, polyvinyl pyrrolidone, acrylamide polymers and so on, can be preferably used. In addition, highly water-absorbing polymers disclosed in JP-A-62-245260, that is, a homopolymer of a vinyl monomer containing —COOM or —$SO_3M$ (where M represents a hydrogen atom or an alkali metal), copolymers prepared from vinyl monomers of the above-described kind alone, or copolymers prepared from the above-described vinyl monomer(s) and other vinyl monomers (e.g., sodium methacrylate, ammonium methacrylate, Sumika Gel L-5H, produced by Sumitomo Chemical Co., Ltd.) can be used. These binders can be used as a combination of two or-more thereof.

When a system in which heat development is carried out in the presence of a slight amount of water supplied externally is employed, the used of the above-described highly water-absorbing polymers enables the rapid absorption of water. Further, the use of the highly water-absorbing polymers in a dye fixing layer or the protective layer thereof can prevent the dyes transferred into the dye fixing element from retransferring into others.

A coverage of the binder used in this invention is properly controlled to not more than 20 g/m$^2$, preferably not more than 10 g/m$^2$, and particularly preferably not more than 7 g/m$^2$.

Constituent layers of the light-sensitive element and the dye-fixing element (including a backing layer) can contain various kinds of polymer latexes for the purpose of enhancing physical properties as film, such as dimensional stability, anticurling, adhesion resistance, cracking resistance and prevention of pressure sensitization or desensitization. Specifically, any of the polymer latexes disclosed in JP-A-62-245258, JP-A-62-136648, JP-A-62-110066, and so on can be used. In particular, polymer latexes having a low glass transition point (below 40° C.) can prevent the generation of cracking when used-in the mordanting layer, and those having a high glass transition point can produce an anticurl effect when used in the backing layer.

Reducing agents which can be used in this invention include those known in the field of heat developable light-sensitive materials. Also, dye-providing compounds having reducing power described hereinafter are included therein. (When the dye-providing compounds of such as kind are employed, other reducing agents can also be used together.) In addition, precursors of reducing agents, which themselves do not have any reducing powder, but acquire it through the interaction with a nucleophilic agent or heat in the course of development, can be used.

Examples of reducing agents and precursors thereof which can be used in this invention include those disclosed in U.S. Pat. No. 4,500,626, columns 49 to 50, U.S. Pat. No. 4,483,914, columns 30 to 31, U.S. Pat. No. 4,330,617, U.S. Pat. No. 4,590,152, JP-A-60-140335, pp. 17 to 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, JP-A-62-131256, EP-A-220746, pp. 78 to 96, and so on.

Various combinations of reducing agents as disclosed in U.S. Pat. No. 3,039,869 can be used, too.

When a nondiffusible reducing agent is used, an electron transmitter and/or a precursor thereof can optionally be used in combination therewith in order to accelerate the transfer of an electron between the nondiffusible reducing agent and a developable silver halide.

Such an electron transmitter or a precursor thereof can be chosen from the above-described reducing agents and precursors thereof. It is desirable that the electron transmitter or the precursor thereof should have mobility greater than that of the nondiffusible reducing agent (electron donator) to be used together. Particularly useful electron transmitters are 1-phenyl-3-pyrazolidones or aminophenoles.

A nondiffusible reducing agent (electron donator) to be used in combination with such an electron transmitter described above may be any of the above-described reducing agents so long as it does not move, in a substantial sense, from one constituent layer to another in the light-sensitive element. As suitable examples thereof, mention may be made of hydroquinones, sulfonamidophenols, sulfonamidonaphthols, the compounds disclosed as electron donators in JP-A-53-

110827, nondiffusible dye-providing compounds having a reducing powder as described hereafter, and so on.

A preferred amount of a reducing agent used in this invention ranges from 0.001 to 20 moles, particularly from 0.01 to 10 moles, per 1 mole of the silver.

First of all, compounds capable of forming dyes by the oxidative coupling reaction (couplers) can be cited as instances of dye-providing compounds usable in this invention. These couplers may be four-equivalent or two-equivalent ones. Also, two-equivalent couplers containing a nondiffusible group as their individual splitting-off groups and producing a diffusible dye by the oxidative coupling reaction can be preferably used. Such a nondiffusible group may assume the form of polymer chain. Specific examples of color developing agents and couplers are described in detail in T. H. James, *The Theory of the Photographic Process,* 4th Ed., pages 291 to 334 and 354 to 361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-3474, JP-A-60-66249, and so on.

As other examples of dye-providing compounds, mention may be made of compounds which have such a function as to release or diffuse imagewise a diffusible dye. The compounds of this type can be represented by the following general formula (LI):

$$(\text{Dye}-\text{Y})_n-Z \qquad \text{(LI)}$$

wherein Dye represents a dye moiety, a dye moiety whose absorption band is temporarily shifted to shorter wavelengths, or a precursor of a dye moiety; Y represents a mere bonding hand, or a linkage group; Z represents such a group as to cause an imagewise change in diffusibility of the compound of the formula $(\text{Dye}-\text{Y})_n-Z$, or to release imagewise the moiety Dye to bring about a difference in diffusibility between the released Dye and $(\text{Dye}-\text{Y})_n-Z$ in correspondence or counter-correspondence with the light-sensitive silver salt imagewise bearing with an latent image; and n represents 1 or 2, and when n is 2, two (Dye−Y)'s may be the same or different.

As specific examples of dye-providing compounds represented by the general formula (LI), mention may be made of those classified into the following groups from (1) to (5). Making additional remarks, the compounds classified into the groups from (1) to (3) are those of the kind which form diffusible dye images in counter-correspondence with the development of silver halide (positive dye images), while the compounds classified into the groups (4) and (5) are those of the kind which form diffusible dye images in correspondence with the development of silver halide (negative dye images).

The group (1) consists of dye developing agents in which a hydroquinone type developing agent and a dye component are connected to each other, with specific examples including those disclosed in U.S. Pat. Nos. 3,134,764, 3,362,819, 3,597,200, 3,544,545 and 3,482,972, and so on. Such dye developing agents are diffusible under an alkaline condition, but rendered nondiffusible by the reaction with silver halide.

The group (2) consists of nondiffusible compounds of the kind which can release a diffusible dye under an alkaline condition, but lose that ability upon the reaction with silver halide, as disclosed in U.S. Pat. No. 4,503,137. Specific examples of each compounds as described above include the compounds capable of releasing a diffusible dye by the intramolecular nucleophilic substitution reaction as disclosed in U.S. Pat. No. 3,980,479 and so on, and the compounds capable of releasing a diffusible dye by the intramolecular rearrangement reaction of an isooxazolone ring as disclosed in U.S. Pat. No. 4,199,354, and so on.

The group (3) consists of nondiffusible compounds of the kind-which can release a diffusible dye by the reaction with a reducing agent which has remained unoxidized through development, as disclosed in U.S. Pat. No. 4,559,290, EP-A-220746, U.S. Pat. No. 4,783,396, Kokai Giho 87-6199, and son on. Specific examples of such compounds include those disclosed in U.S. Pat. Nos. 4,139,389 and 4,139,379, JP-A-59-185333, JP-A-57-84453 and so on, which can release a diffusible dye by the intramolecular nucleophilic substitution reaction after they are reduced; those disclosed in U.S. Pat. No. 4,232,107, JP-A-59-101649, JP-A-61-88257, RD24025 (April, 1984) and so on, which can release a diffusible dye by the intramolecular electron transfer reaction after they are reduced; those disclosed in West German Patent 3,008,588A, JP-A-56-142530, U.S. Pat. No. 4,343,893, U.S. Pat. No. 4,619,884, and so on, which can release a diffusible dye by the single-bond cleavage after the reduction; the nitro compounds disclosed in U.S. Pat. No. 4,450,223 and so on, which can release a diffusible dye after the electron acceptance; the compounds disclosed in U.S. Pat. No. 4,609,610 and so on, which can release a diffusible dye after the electron acceptance; and so on.

More preferred examples of compounds belonging to this group include those having both a N—X bond (where X represents an oxygen, sulfur or nitrogen atom) and an electron attractive group in a molecule, as disclosed in EP-A-220746, Kokai Giho 87-6199, U.S. Pat. No. 4,783,396, Japanese Patent Application Nos. 62-34953 and 62-34594 (corresponding to JP-A-63-201653 and JP-A-63-201654, respectively), and so on; those having both a $SO_2$—X bond (where X has the same meaning as described above) and an electron attractive group in a molecule, as disclosed in Japanese Patent Application No. 62-106885 (corresponding to JP-A-1-26842); those having both a PO—X bond (where X has the same meaning as described above) and an electron attractive group in a molecule, as disclosed in Japanese Patent Application No. 62-106895 (corresponding to JP-A-63-271344); and those having both a C—X'bond (where X' has the same meaning as X, or represents —$SO_2$—) and an electron attractive group in a molecule, as disclosed in Japanese Patent Application No. 62-106887 (corresponding to JP-A-63-271341). Further, compounds which release a diffusing dye by the cleavage of a single bond after reduction by a $\pi$ bond conjugated with an electron-accepting group as described in Japanese Patent Application Nos. 62-319989 and 62-320771 (corresponding to JP-A-1-161237 and JP-A-1-161342, respectively), can be used.

Among these compounds, those having both a N—X bond and an electron attractive group in a molecule are preferred in particular. Specific examples of such compounds include those cited in EP-A-220746 and U.S. Pat. No. 4,783,396 as the compound examples (1) to (3), (7) to (10), (12), (13), (15), (23) to (26), (31), (32), (35), (36), (40), (41), (44), (53) to (59), (64) and (70), and those cited in Kokai Giho 87-6199 as the compound examples (11) to (23).

The group (4) consists of couplers of the kind which have a diffusible dye residue as a splitting-off group and release the diffusible dye by the reaction with the oxidation product of a reducing agent (DDR couplers). Specific examples of such couplers include those disclosed in British Patent 1,330,524, JP-B-48-39165, U.S. Pat. Nos. 3,443,940, 4,474,867 and 4,483,914, and so on.

The group (5) consists of compounds of the kind which can reduce silver halides or organic silver salts, and release a diffusible dye upon the reduction of these silver salts (DRR compounds). Since these compounds do not require the combined use with other reducing agents, they have an advantage in that they can produce images free from stains arising from the oxidative decomposition products of reducing agents. Representatives of these DRR compounds are disclosed in U.S. Pat. Nos. 3,928,312, 4,053,312, 4,055,428 and 4,336,322, JP-A-59-65839, JP-A-59-69839, JP-A-53-3819, JP-A-51-104343, RD17465 (October, 1978), U.S. Pat. Nos. 3,725,062, 3,728,113 and 3,443,939, JP-A-58-116,537, JP-A-57-179840, U.S. Pat. Nos. 4,500,626, and so on. As specific examples of DRR compounds which can be preferably used in this invention, mention may be made of the compounds illustrated on the columns from 22nd to 44th of the above-cited U.S. Pat. No. 4,500,626, particularly those illustrated as the compound examples (1) to (3), (10) to (13), (16) to (19), (28) to (30), (33) to (35), (38) to (40), and (42) to (64). In addition, the compounds disclosed on the columns from 37th to 39th of the above-cited U.S. Pat. No. 4,639,408 are useful, too.

As dye-providing compounds other than the above-described couplers and the compounds represented by the general formula (LI), dye silver compounds in which an organic silver salt and a dye are bound to each other (as described in *Research Disclosure,* Vol. 169, pages 54 to 58 (May, 1978)), azo dyes which can be used in heat developable silver dye bleach process (as disclosed in U.S. Pat. No. 4,235,957, Research Disclosure, Vol. 144, pages 30 to 32 (April, 1976)), leuco dyes (as disclosed in U.S. Pat. No. 3,985,565 and 4,022,617), and so on can be employed in this invention.

Hydrophobic additives including dye-providing compounds, nondiffusible reducing agents and so on can be introduced into constituent layers of the light-sensitive element according to known methods described, e.g., in U.S. Pat. No. 2,322,027. Therein, high boiling organic solvents as disclosed in JP-A-59-83154, JP-A-59-178451, JP-A-59-178452, JP-A-59-178453, JP-A-59-178454, JP-A-59-178455, JP-A-59-178457 and so on can be used, if necessary, together with low boiling organic solvents having a boiling point ranging from 50° C. to 160° C.

An amount of the high boiling organic solvent used is controlled to 10 g or less, preferably 5 g or less, per 1 g or the dye-providing compounds. As for the amount of the high boiling organic solvent used per 1 g of the binder, it is appropriately 1 ml or less, preferably 0.5 ml of less, and particularly preferably 0.3 ml or less.

Introduction of hydrophobic additives into the light-sensitive element can be effected in accordance with a dispersion method utilizing polymers as disclosed in JP-B-51-39853 and JP-A-51-59943.

In addition to the above-described methods, compounds which are insoluble in water in a substantial sense can be introduced by dispersing fine grains of them into a binder.

In dispersing hydrophobic compounds into a hydrophilic colloid, various kinds of surfactants can be used. For instance, those exemplified as surfactant on the pages 37 and 38 of JP-A-59-157636 can be employed therein.

Compounds which can promote the activation of development and the stabilization of image at the same time can be used in the light-sensitive element in this invention. Specific examples of such compounds which can be preferably used are described on the columns 51 and 52 of U.S. Pat. No. 4,500,626.

In the system of forming images by the diffusion transfer of dyes, a dye-fixing element is used in combination with the light-sensitive element. The dye-fixing element and the light-sensitive element may be provided independently on separate supports, or may be provided in layers on the same support. As for the correlation of the dye-fixing element with the light-sensitive element, and as for the relations of the dye-fixing element to a support and to a white reflective layer, those described on the column 57 of U.S. Pat. No. 4,500,626, can be applied to this invention.

A dye-fixing element which is preferably used in this invention has at least one layer containing a mordant and a binder. Therein, mordants known in the photographic art can be used, and specific examples thereof include those described on the columns 58 and 59 of U.S. Pat. No. 4,500,626, on the pages from 32 to 41 of JP-A-61-88256, and particularly preferably include those disclosed in JP-A-62-244043 and JP-A-62-244036. In addition, dye-accepting high molecular compounds as disclosed in U.S. Pat. No. 4,463,079 may be used as the mordant.

The dye-fixing element can be provided with auxiliary layers, such as a protective layer, a peeling-apart layer, an anticurl layer and so on, if desired. In particular, it is useful to provide a protective layer.

In constituent layers of the light-sensitive element and the dye-fixing element, a plasticizer, a slipping agent or a high boiling organic solvent for enhancing a facility in peeling apart the dye-fixing element from the light-sensitive element can be contained. Specific examples thereof include those disclosed in JP-A-62-253159 (page 25), JP-A-62-245253 and so on.

For the above-described purpose, various silicone oils (covering from dimethylsilicone oil to modified silicone oils prepared by introducing various kinds of organic groups into dimethylsiloxane) can be further used. As examples of effective silicone oils, mention may be made of a wide variety of modified silicone oils described in "Hensei Silicone Oil" Gijutsu Shiryo P6-18B (which means technical data on modified silicone oils), published by Shin-etsu Silicone Co., Ltd. In particular, carboxy-modified silicone (trade name; X-22-3710) is used to advantage.

In addition, silicone oils disclosed in JP-A-62-215953 and Japanese Patent Application No. 62-23687 (corresponding to JP-A-63-46449) are effective, too.

The light-sensitive elements and the dye-fixing element may contain a discoloration inhibitor. Suitable discoloration inhibitors include, e.g., antioxidants, ultraviolet absorbents and certain metal complexes.

Suitable antioxidants include, e.g., chroman compounds, coumaran compounds, phenol compounds (e.g., hindered phenols), hydroquinone derivatives, hindered amine compounds, and spiroindane compounds. Also, the compounds disclosed in JP-A-61-159644 are effective as antioxidants.

Suitable ultraviolet absorbents include benzotriazole compounds (as disclosed in U.S. Pat. No. 3,533,794), 4-thiazolidone compounds (as disclosed in U.S. Pat. No. 3,352,681), benzophenone compounds (as disclosed in JP-A-46-2784), and other compounds as disclosed in JP-A-54-48535, JP-A-62-136641 and JP-A-61-88256. In addition; the ultraviolet absorbing polymers disclosed in JP-A-62-260152 are also effective.

Suitable metal complexes include the compounds disclosed, e.g., in U.S. Pat. No. 4,241,155, 4,245,018 (columns 3 to 36) and U.S. Pat. No. 4,254,195 (columns 3 to 8), JP-A-62-174741, JP-A-61-88256 (pages 27 to 29), Japanese Patent Application Nos. 62-234103 and 62-31096 (corresponding to JP-A-1-75568 and JP-A-63-199248, and so on.

Examples of useful discoloration inhibitors are described in JP-A-62-215272 (pages 125 to 137).

Discoloration inhibitors for preventing the dyes transferred in the dye-fixing element from undergoing discoloration may be incorporated in advance in the dye-fixing element, or supplied externally (e.g. from the light-sensitive element) to the dye-fixing element.

The above-described antioxidants, ultraviolet absorbents and metal complexes may be used in combination.

In the light-sensitive element and the dye-fixing element, a brightening agent may be used. In particular, it is desirable that a brightening agent should be incorporated in the dye-fixing element or supplied externally (e.g., from the light-sensitive element) thereto. As examples of a brightening agent which can be used, mention may be made of the compounds as described in K. Veenkataraman (editor), *The Chemistry of Synthetic Dyes,* volume V, chapter 8, JP-A-61-143752, and so on. More specifically, stilbene compounds, coumarin compounds, biphenyl compounds, benzoxazolyl compounds, naphthalimide compounds, pyrazoline compounds, carbostyryl compounds and the like can be effectively used as the brightening agent.

These brightening agents can be used in combination with discoloration inhibitors.

Hardeners (hardening agents) suitable for the use in constituent layers of the light-sensitive element and the dye-fixing element are those disclosed in U.S. Pat. No. 4,678,739 (column 41), JP-A-59-116655, JP-A-62-245261, JP-A-61-18942, and so on. More specifically, there can be cited aldehyde type hardeners (e.g., formaldehyde), aziridine type hardeners, epoxy type hardeners (e.g.,

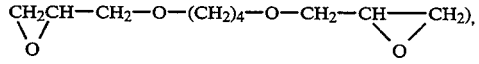

vinylsulfon type hardeners (e.g., N,N'-ethylene-bis(-vinylsulfonylacetamido)ethane), N-methylol type hardeners (e.g., dimethylol urea), and high molecular hardeners (e.g., the compounds disclosed in JP-A-62-234157).

For various purposes, e.g., as a coating aid, for the enhancement of peeling facility and slippability, for the prevention of electrification, for the acceleration of development, and so on, various surfactants can be used in constituent layers of the light-sensitive element and the dye-fixing element. Specific examples of surfactants suitable for the above-described purposes include those disclosed in JP-A-62-173463, JP-A-62-183457, and so on.

For the purposes of improvements in slippability, antistatic property, peeling facility and so on, organic fluorinated compounds may be incorporated in constituent layers of the light-sensitive element and the dye-fixing element. As typical representatives of such organic fluorinated compounds, there can be cited fluorine-containing surfactants disclosed in JP-B-57-9053 (columns 8 to 17), JP-A-61-20944, JP-A-62-135826 and so on, and hydrophobic fluorine compounds including oily fluorine compounds, such as fluorine-containing oil, and solid fluorine-containing resins, such as tetrafluorinated ethylene resin.

A matting agent can be used in the light-sensitive element and the dye-fixing element. As examples of a matting agent which can be used, mention may be made of silicon dioxide, the compounds described in JP-A-61-88256 (page 29), such as polyolefins, polymethylmethacrylate and the like, and the compounds disclosed in Japanese Patent Application Nos. 62-110064 and 62-110065 (corresponding to JP-A-63-274944 and JP-A-63-274952, respectively), such as benzoguanamine resin beads, polycarbonate resin beads, AS resin beads and the like.

In addition to the above-cited additives, thermal solvents, defoaming agents, antibacteria and antimolds, colloidal silica and so on may be incorporated in constituent layers of the light-sensitive element and the dye-fixing element. Specific examples of these additives are described, e.g., in JP-A-61-88256 (pages 26 to 32).

In the light-sensitive element and/or the dye-fixing element of this invention, image-formation accelerators can be used. The image-formation accelerators have such functions that they can accelerate the redox reaction between a silver salt oxidizing agent and a reducing agent, the production of dyes, the decomposition of dyes or the release of diffusible dyes from dye-providing compounds, and the transfer of the dyes from the light-sensitive element to the dye-fixing element. From the standpoint of physicochemical functions, the image-formation accelerators are classified into groups, such as bases, base precursors, nucleophilic compounds, high boiling organic solvents (oils), thermal solvents, surfactants, compounds having an interaction with silver or silver ion, and so on. In general, substances belonging to these groups have combined functions, and each substance usually has some of the above-cited acceleration effects. Details of these accelerators and their functions are described in U.S. Pat. No. 4,678,739 (pages 38 to 40).

As examples of base precursors, there can be given the salts prepared from bases and organic acids to be decarboxylated by heating, and compounds capable of releasing amines by undergoing the intramolecular nucleophilic substitution reaction, Lossen rearrangement or Beckmann rearrangement. More specifically, such compounds are described in U.S. Pat. No. 4,511,493, JP-A-62-65038, and so on.

In a system of the type which performs heat development and the dye transfer at the same time in the presence of a small amount of water, it is to be desired for the enhancement of keeping quality of the light-sensitive element that a base and/or a precursor thereof should be incorporated in the dye-fixing element.

In addition to the above-cited compounds, combinations of slightly soluble metal compounds and compounds capable of undergoing the complexation reaction (called complexing compounds) with metal ions constituting these metal compounds, as disclosed in EP-A-210660, and compounds capable of producing bases through electrolysis, as disclosed in JP-A-61-232451 can be used as base precursors. In particular, the former combination is effective, and it is more advantageous that a slightly soluble metal compound and a complexing compound are incorporated separately in the light-sensitive element and the dye-fixing element.

Various development stoppers can be used in the light-sensitive element and/or the dye-fixing element of this invention for the purpose of stationarily producing images of the same quality in spite of fluctuations in processing temperature and processing time during the development.

The term development stopper as used herein describes a compound of the kind which can stop the development by rapidly neutralizing a base or reacting with a base after the proper development to lower the base concentration in the film, or can retard the development through the interaction with silver or a silver salt. Specific examples thereof include acid precursors capable of releasing acids by heating, electrophilic compounds capable of causing a substitution reaction with a base present together by heating, nitrogen-containing heterocyclic compounds, mercapto compounds and precursors thereof, and so on. Details of these compounds are described in JP-A-62-253159 (pages 31 to 32).

As a support of the light-sensitive element and the dye-fixing element of this invention, materials which can withstand processing temperatures to be employed are used. In general, paper and synthetic polymers (films) can be cited as instances. Specific examples of usable supports include films of polyethylene terephthalate, polycarbonate, polyvinyl chloride, polystyrene, polypropylene, polyimide and celluloses (e.g., triacetyl cellulose), those prepared by dispersing a pigment, such as titanium oxide, into such films as cited above, film process synthetic paper made from polypropylene or the like, paper made from a mixture of synthetic resin pulp, such as polyethylene pulp, and natural-pulp, Yankee paper, baryta paper, coated paper (especially cast-coated paper), metals, cloths, glasses, and so on.

These materials may be used individually as they are, or some of them are used in a condition that they are laminated with a synthetic polymer, such as polyethylene or the like, on one side or both sides thereof.

In addition to the above-cited supports, those described in JP-A-62-253159 (pages 29 to 31) can be employed.

On the surface of a support as described above, a hydrophilic binder, alumina sol, a semi-conductive metal oxide such as tin oxide, and an antistatic agent such as carbon black may be coated.

In exposing the light-sensitive element to light with imagewise patterns to record it therein, there can be adopted various exposing methods, e.g., a method of directly taking photographs of sceneties and figures with a camera or the like, a method of exposing the light-sensitive element to light through a reversal film or a negative film using a printer, an enlarger or the like, a method of scanning rays of light passing through a slit over an original with an exposure apparatus installed in a copying machine or the like, a method of forcing a light emission diode or a wide variety of laser devices to emit light by sending thereto electric signals bearing with image information, and irradiating the light-sensitive element with the emitted light, a method of putting out image information on an image display unit such as a CRT, a liquid crystal display, an electroluminescence display or a plasma display screen, and exposing the light-sensitive element to the displayed image directly or through an optical system, and so on.

Light sources suitable for recording images in the light-sensitive element include natural light, a tungsten lamp, light emission diodes, laser light sources, CRT light sources and so on, as described in U.S. Pat. No. 4,500,626, column 56.

Also, imagewise exposure can be performed by using a wavelength changing element made by combining a nonlinear optical material and a coherent light source such as laser beams. The term nonlinear optical material as used herein refers to the material of the kind which can create a nonlinearity relationship between the electric field and the polarization to emerge upon application of a strong photoelectric field such as laser beams. Compounds preferred as such an nonlinear optical material as defined above include inorganic compounds represented by lithium niobate, potassium dihydrogen phosphate (KDP), lithium iodate, $BaB_2O_4$ and the like, urea derivatives, nitroaniline derivatives, nitropyridine-N-oxide derivatives such as 3-methyl-4-nitropyridine-N-oxide (POM), and the compounds disclosed in JP-A-61-53462 and JP-A-62-210432. As for the form of the wavelength changing element, that of a single-crystal light-waveguide lane, that of a fiber and so on are known, and each is useful in this invention.

As for the image information, those obtained from video cameras, electronic still cameras or the like, television signals of NTSC color system (NTSC: Nippon Television Signal Code), image signals obtained by dividing an original into a great number of image elements using a scanner or the like, and image signals produced by the use of a computer which are represented by CG and CAD can be utilized.

The light-sensitive element and/or the dye-fixing element may be provided with a conductive heat-emission layer to function as heating means for heat development or diffusion transfer of dyes. Therein, transparent or opaque heat-emission elements described, e.g., in JP-A-61-145544 can be utilized. Making an additional remark, such as conductive layer as described above can function as an antistatic layer, too.

It is possible to effect the heat development by heating at temperatures of about 50° C. to about 250° C. In particular, heating temperatures ranging from about 80° C. to about 180° C. are useful. The dye diffusion transfer step may be carried out at the same time as the heat development step, or after the conclusion of the heat development step. In the latter case, it is possible to achieve the transfer as far as heating temperature adopted in the transfer step is in the range of the temperature adopted in the heat development step to room temperature. However, the transfer can be accomplished more efficiently under a heating temperature ranging from 50° C. to the temperature lower than that adopted in the heat development step by about 10° C.

The transfer of dyes, though can be caused by heat alone, may be carried out with the aid of a solvent of the kind which can promote the dye transfer.

In addition, as described in detail in JP-A-59-218443, JP-A-61-238056 and so on, a method of heating in the presence of a small amount of solvent (especially water) to achieve the development and the transfer simultaneously or successively can be used to advantage. In this method, a preferred heating temperature is in the range of 50° C. to a boiling point of the solvent used. For instance, temperatures from 50° C. to 100° C. are desirable when water is used as the solvent.

As examples of solvents which can be used for the acceleration of development and/or the transfer of diffusible dyes into the dye-fixing layer, mention may be made of water and basic aqueous solutions containing inorganic alkali metal salts or organic bases. (As for the bases, those given as examples of image-formation accelerators hereinbefore can be used.) Also, a low boiling solvent, or a mixture of a low boiling solvent with water or a basic aqueous solution can be used for the above-described purpose(s). Further, surfactants, antifogging agents, slightly soluble metal salts and complexing compounds may be contained in solvents as described above.

These solvents each can be used in such a manner that it may be given to either the dye-fixing element or the light-sensitive element, or both of them. Each solvent can serve its purpose when used in such a small amount as to be below the weight of the solvent having a volume equivalent to the maximal swelling volume of the whole layers coated (especially below the weight obtained by deducting the weight of the whole layers coated from the weight of the solvent having a volume equivalent to the maximal swelling volume of the whole layers coated).

The solvent can be given to the light-sensitive layer or the dye-fixing layer in accordance with, e.g., the method described in JP-A-61-147244 (page 26). Also, it can be used in such a condition as to be incorporated in advance in the light-sensitive element or the dye-fixing element in the microencapsulated from or the like.

In order to promote the dye transfer, there can be adopted a method of incorporating a hydrophilic thermal solvent, which melts at high temperatures though it is a solid at ordinary temperatures, into the light-sensitive element or the dye-fixing element. The hydrophilic thermal solvent may be incorporated into either the light-sensitive element or the dye-fixing element, or both of them. It may be incorporated in any of the constituent layers including emulsion layers, interlayers, protective layers and dye-fixing layers. However, it is desirable that the hydrophilic thermal solvent should be incorporated into a dye-fixing layer and/or the layers adjacent thereto.

Suitable examples of hydrophilic thermal solvents include ureas, pyrimidines, amides, sulfonamides, imides, alcohols, oximes and other heterocyclic compounds.

Further, a high boiling solvent may be incorporated in the light-sensitive element and/or the dye-fixing element in order to promote the dye transfer.

The heating in the development and/or the transfer step can be effected, e.g., by the direct contact with heated block and plate, or the contact with a hot plate, a hot presser, a hot roller, a halogen lamp heater or an infrared and far infrared lamp heater, or the passage through high temperature atmosphere. Alternatively, the light-sensitive element or dye fixing element may be provided with a resistive heat-emission layer so that it is heated by passing an electric current through the resistive heat-emission layer. As such a resistive heat-emission layer there may be used the one described in JP-A-61-145544.

In bringing the light-sensitive element and the dye-fixing element into a face-to-face close contact with each other, the pressure application conditions and the pressure-applying means described in JP-A-61-147244 (page 27) can be properly adopted.

For photographic processing of the photographic elements of this invention, any of conventional heat developing apparatuses can be employed. For instance, apparatuses as disclosed in JP-A-59-75247, JP-A-59-177547, JP-A-59-181353, JP-A-60-18951, JP-A-U-62-25944 (the term "JP-A-U" as used herein means an "unexamined published Japanese utility model application"), and so on can be preferably used.

This invention will now be illustrated in more detail by reference to the following examples, but this invention should not be construed as being limited thereto. The percentages hereafter are by weight unless otherwise indicated.

EXAMPLE 1

A light-sensitive element 101 having the structure given in Table 1 was prepared.

TABLE 1

| Layer No. | Function | Additive | Amount ($g/m^2$) |
|---|---|---|---|
| Sixth layer | protective layer | gelatin | 0.9 |
| | | matting agent (silica) | 0.116 |
| | | water-soluble polymer (1) | 0.228 |
| | | sur factant (1) | 0.064 |
| | | surfactant (2) | 0.036 |
| | | hardening agent | 0.018 |
| | | surfactant (3) | 0.06 |
| | | surfactant (6) | 0.072 |
| Fifth layer | green-sensitive layer | emulsion (I) | 0.4 |
| | | organic silver salt (2) | 0.036 (in terms of silver) |
| | | acetylene compound | 0.022 |
| | | yellow dye-providing compound (Y-1) | 0.36 |
| | | yellow dye-providing compound (Y-2) | 0.09 |
| | | high-boiling organic solvent (1) | 0.225 |
| | | reducing agent (1) | 0.009 |
| | | mercapto compound (1) | 0.009 |
| | | surfactant (3) | 0.06 |
| Fifth layer | green-sensitive layer | water-soluble polymer (2) | 0.02 |
| | | hardening agent | 0.013 |
| | | gelatin | 0.64 |
| | | surfactant (5) | 0.045 |
| Fourth layer | interlayer | gelatin | 0.7 |
| | | $Zn(OH)_2$ | 0.3 |
| | | surfactant (1) | 0.001 |
| | | water-soluble polymer (2) | 0.03 |
| | | hardening agent | 0.014 |
| | | surfactant (4) | 0.029 |
| Third layer | red-sensitive layer | emulsion (IV) | 0.21 |
| | | organic silver salt (1) | 0.035 (in terms of silver) |
| | | organic silver salt (2) | 0.035 (in terms of silver) |
| | | gelatin | 0.44 |
| | | magenta dye-donating material (M) | 0.3 |
| | | high-boiling organic solvent (1) | 0.15 |
| | | reducing agent (1) | 0.006 |
| | | mercapto compound (1) | 0.003 |
| | | surfactant (4) | 0.029 |
| Third layer | red-sensitive layer | water-soluble polymer (2) | 0.013 |
| | | surfactant (5) | 0.03 |
| | | hardening agent | 0.009 |
| Second layer | interlayer | gelatin | 0.77 |
| | | $Zn(OH)_2$ | 0.3 |
| | | surfactant (4) | 0.047 |
| | | water-soluble polymer (2) | 0.038 |
| | | surfactant (1) | 0.046 |
| | | hardening agent | 0.016 |
| First | infrared- | emulsion (VII) | 0.26 |

TABLE 1-continued

| Layer No. | Function | Additive | Amount (g/m²) |
|---|---|---|---|
| layer | sensitive layer | organic silver salt (1) | 0.035 (in terms of silver) |
| | | organic silver salt (2) | 0.035 (in terms of silver) |
| | | mercapto compound (2) | $4 \times 10^{-4}$ |
| | | sensitizing dye* | $5 \times 10^{-5}$ |
| | | cyan dye-providing compound (C) | 0.325 |
| | | high-boiling organic solvent (1) | 0.162 |
| | | reducing agent (1) | $8.7 \times 10^{-3}$ |
| | | mercapto compound (1) | 0.013 |
| | | –surfactant (4) | 0.094 |
| First layer | infrared-sensitive layer | surfactant (5) | 0.032 |
| | | water-soluble polymer (2) | 0.018 |
| | | gelatin | 0.5 |
| | | hardening agent | 0.01 |
| Support (polyethylene terephthalate; thickness: 100 μm) | | | |
| Backing layer | | carbon black | 0.44 |
| | | polyester | 0.30 |
| | | polyvinyl chloride | 0.30 |

The components of the above layers are described in greater detail below:

*Compound II-1

High-boiling organic solvent (1): trinonyl phosphate

Water-soluble polymer (1):
(highly water-absorbing polymer) Sumikagel L-5(H) (a product of Sumitomo Chemical Co., Ltd)

Water-soluble polymer (2): (highly water-absorbing polymer)

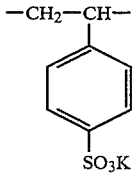

Surfactant (1): Aerosol OT

Surfactant (2):

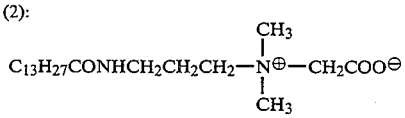

Surfactant (3):

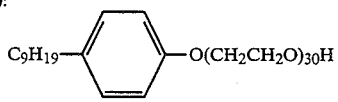

Surfactant (4):

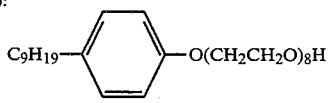

Surfactant (5):

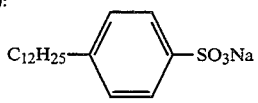

-continued

Surfactant (6):

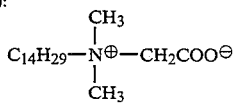

Hardening agent: 1,2-bis(vinylsulfonylacetamido)ethane

Silicone oil (1):

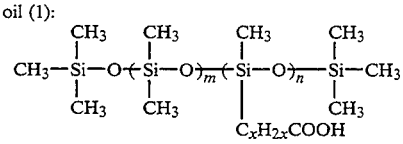

Acetylene compound:

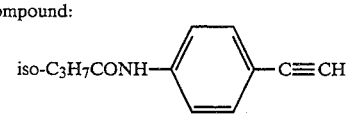

Reducing agent (1):

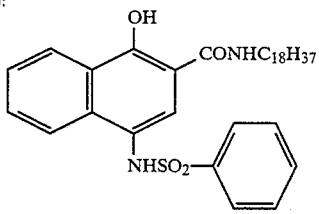

Mercapto compound (1):

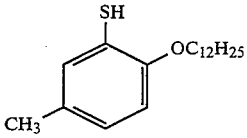

Mercapto compound (2):

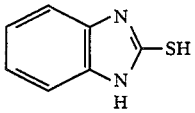

The emulsion for the fifth layer was prepared in the following manner.

Emulsion (I)

Twenty g of gelatin, 3 g of sodium chloride and 0.015 g of a compound having the following formula

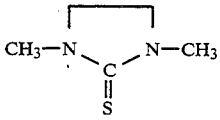

were dissolved in 800 ml of water and the resulting aqueous gelatin solution was kept at 65° C. with stirring. To the stirred aqueous gelatin solution, there were added the following solutions I and II over a period of 70 minutes. The addition of a dye solution of 0.24 g of the following sensitizing dye (A) dissolved in a solution consisting of 120 ml of methanol and 120 ml of water was begun simultaneously with the commencement of the addition of the solutions I and II. The dye solution was added over a period of 60 minutes.

Sensitizing dye (A):

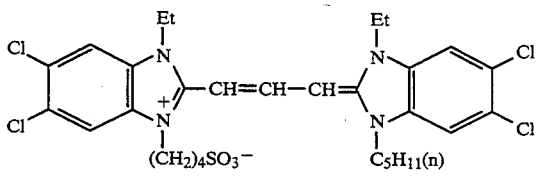

| | Solution I (total volume of 600 ml) | Solution II (total volume of 600 ml) |
|---|---|---|
| $AgNO_3$ | 100 g | — |
| KBr | — | 56 g |
| NaCl | — | 7 g |

Immediately after the completion of the addition of the solutions I and II, 2 g of KBr was dissolved in 20 ml of water and added thereto. The mixture was left to stand for 10 minutes.

After water washing and desalting, 25 g of gelatin and 100 ml of water were added thereto to adjust the pH to 6.4 and the pAg to 7.8. The resulting emulsion was a cubic monodisperse emulsion having a grain size of about 0.5 μm.

The emulsion was kept at 60° C. 1.3 mg of triethylthiourea and 100 mg of 4-hydroxy-6-methyl-1,3,3a,7-tetrazaindene were simultaneously added thereto to effect thereby the optimum chemical sensitization. The yield was 650 g.

The emulsion for the third layer was prepared in the following manner.

Emulsion (IV)

Twenty g of gelatin, 2 g of sodium chloride and 0.015 g of the following compound

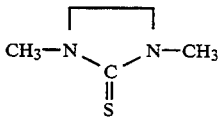

were dissolved in 800 ml of water and the resulting aqueous gelatin solution was kept at 65° C. with stirring. To the stirred aqueous gelatin solution, there were added the following solutions I and II over a period of 60 minutes. The addition of a dye solution of 0.16 g of the following sensitizing dye (B) dissolved in 80 ml of methanol was begun simultaneously with the commencement of the addition of the solution I and II. The dye solution was added over a period of 40 minutes.

Sensitizing dye (B):

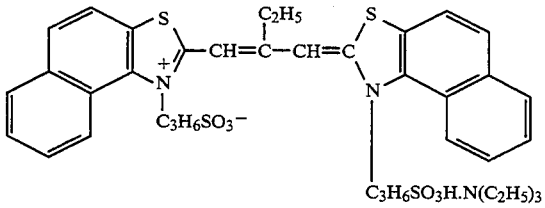

| | Solution I (total volume of 600 ml) | Solution II (total volume of 600 ml) |
|---|---|---|
| $AgNO_3$ | 100 g | — |
| KBr | — | 56 g |
| NaCl | — | 7 g |

After the completion of the addition of the solutions I and II, the resulting mixture was left to stand for 10 minutes. The temperature was lowered, and water washing and desalting were carried out. Twenty-five g of gelatin and 100 ml of water were added thereto to adjust the pH to 6.5 and the pAg to 7.8.

After the pH and the pAg were adjusted, triethylthiourea and 4-hydroxy-6-methyl-1,3,3a,7-tetrazaindene were added thereto and the optimum chemical sensitization was effected at 60° C.

The resulting emulsion was a cubic monodisperse emulsion having a grain size of about 0.35 μm. The yield was 650 g.

The emulsion for the first layer was prepared in the following manner.

Emulsion (VII)

Twenty g of gelatin, 4 g of sodium chloride and 0.02 g of the following compound

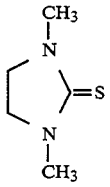

were dissolved in 1000 ml of water and the resulting aqueous solution was kept at 60° C. with stirring. To the stirred aqueous gelatin solution, there were added simultaneously 600 ml of an aqueous solution containing 49 g of potassium bromide and 10.5 g of sodium chloride and an aqueous solution of silver nitrate (a solution of 0.59 mol of silver nitrate dissolved in 600 ml of water) at an equal flow rate over a period of 50 minutes. After water washing and desalting, 25 g of gelatin and 200 ml of water were added thereto to adjust the pH to 6.4. The optimum chemical sensitization was carried out by using triethylthiourea and 4-hydroxy-6-methyl-1,3,3a,7-tetrazaindene. Seven hundred g of a cubic monodisperse emulsion (VII) having a mean grain size of 0.4 μm was obtained.

The preparation of the organic silver salt will be illustrated below.

Organic Silver Salt (1)

Benztriazole silver emulsion was prepared in the following manner.

Twenty-eight g of gelatin and 13.2 g of benztriazole were dissolved in 300 ml of water. The resulting solution was kept at 40° C. and stirred. To the solution, there was added a solution of 17 g of silver nitrate dissolved in 100 ml of water over a period of 2 minutes.

The pH was adjusted to precipitate the resulting benztriazole silver emulsion. An excess of salt was removed. Thereafter, the pH was adjusted to 6.30, thus obtaining 400 g of benztriazole silver emulsion.

Organic Silver Salt (2)

Twenty g of gelatin and 5.9 g of 4-acetylaminophenylpropiolic acid were dissolved in a mixture of 1000 ml of an aqueous solution of 0.1% sodium hydroxide and 200 ml of ethanol. The resulting solution was kept at 40° C. and stirred.

To the solution, was added a solution of 4.5 g of silver nitrate dissolved in 200 ml of water over a period of 5 minutes.

The pH of the dispersion was adjusted to precipitate the product. An excess of salt was removed. The pH was adjusted to 6.3, thus obtaining a dispersion of an organic silver salt (2). The yield was 300 g.

The preparation of the gelatin dispersion of the dye-providing compound will be illustrated below.

Twelve g of a yellow dye-providing compound (Y−1), 3 g of yellow dye-providing compound (Y-2), 7.5 g of high-boiling organic solvent (1), 0.3 g of reducing agent (1) and 0.3 g of mercapto compound (1) were dissolved in 45 ml of ethyl acetate. One hundred g of 10% gelatin solution and 60 ml of a 2.5% aqueous solution of sodium dodecylbenzenesulfonate were mixed with the above solution with stirring. The mixture was dispersed in a homogenizer at 10,000 rpm for 10 minutes. The resulting dispersion is referred to as the dispersion of yellow dye-providing compound.

Fifteen g of magenta dye-providing compound (M), 7.5 g of high-boiling organic solvent (1), 0.3 g of reducing agent (1) and 0.15 g of mercapto compound (1) were dissolved in 25 ml of ethyl acetate. One hundred g of 10% gelatin solution and 60 ml of a 2.5% aqueous solution of sodium dodecylbenzenesulfonate were mixed with the above solution by stirring. The mixture was dispersed in a homogenizer at 10,000 rpm for 10 minutes. The resulting dispersion is referred to as the dispersion of magenta dye-providing compound.

Fifteen g of cyan dye-providing compound (C), 7.5 g of high-boiling organic solvent (1), 0.4 g of reducing agent (1) and 0.6 g of mercapto compound (1) were dissolved in 40 ml of ethyl acetate. One hundred g of 10% gelatin solution and 60 ml of a 2.5% aqueous solution of sodium dodecylbenzenesulfonate were mixed with the above solution by stirring. The mixture was dispersed in a homogenizer at 10,000 rpm for 10 minutes. The resulting dispersion is referred to as the dispersion of cyan dye-providing compound.

(Y-1)

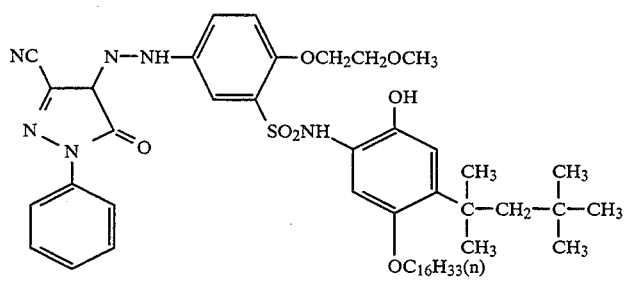

(Y-2)

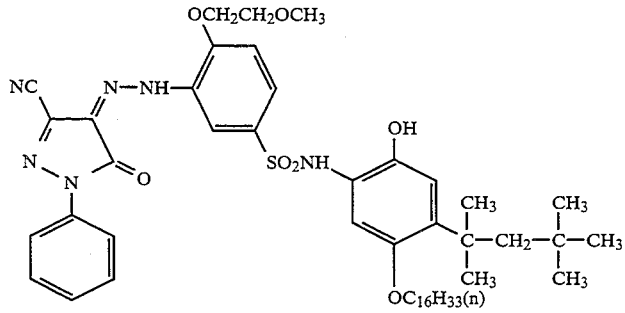

-continued (M)

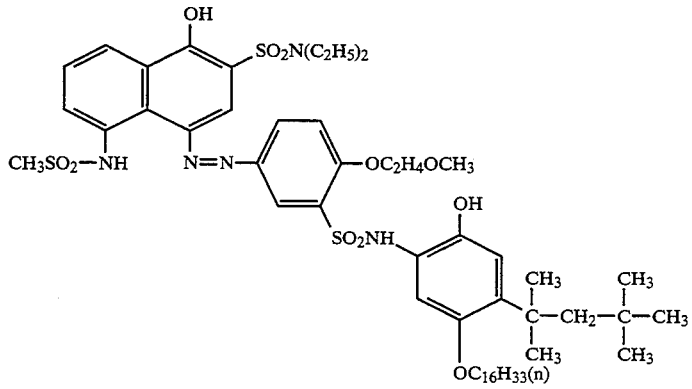

(C)

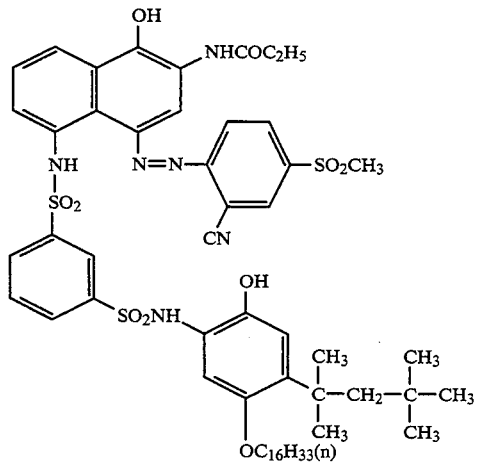

The preparation of the dye-fixing-element will be illustrated below.

The surface of a polyethylene-laminated paper support was coated with the following layers to prepare a dye-fixing element.

| | |
|---|---|
| Second layer | |
| Gelatin | 0.7 g/m$^2$ |
| Hardening agent*1 | 0.24 g/m$^2$ |
| First layer | |
| Gelatin | 1.4 g/m$^2$ |
| Mordant*2 | 2.6 g/m$^2$ |
| Picolinic acid guanidium salt | 2.5 g/m$^2$ |
| Support | |

*1 1,2-Bis(vinylsulfonylacetamido)ethane

*2

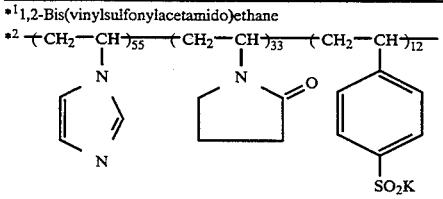

After the completion of the preparation of emulsion (I), a spectral sensitizing dye having sensitizing wavelength in the region of wavelength of 700 nm or above was added to the fifth layer as shown in the following Table 2. The amount of the spectral sensitizing dye added was $5\times10^{-5}$ g/m$^2$.

Each of the resulting light-sensitive elements had the same layer structure and additives as those of light-sensitive element 101 except that the above spectral sensitizing dye was additionally used.

TABLE 2

| Light-Sensitive Element | 101 | 102 | 103 | 104 |
|---|---|---|---|---|
| Spectral sensitizing dye additionally contained in the fifth layer (green-sensitive layer) and its maximum sensitization wavelength (amount added: $5\times10^{-5}$ g/m$^2$) | omitted | I-5 | I-7 | I-17 |
| | — | 730 nm | 750 nm | 780 nm |
| Maximum sensitization wavelength of the third layer | 680 nm | 680 nm | 680 nm | 680 nm |
| maximum sensitization wavelength of the first layer | 810 nm | 810 nm | 810 nm | 810 nm |
| | Comp. Ex. | inven-tion | inven-tion | Comp. Ex. |

These light-sensitive elements were exposed by using a color printer Pictrography (manufactured by Fuji Photo Film Co., Ltd.) and changing the quantity of light of light-emitting diode (LED). The printer was provided with three light-emitting diodes of 570 nm, 670 nm and 810 nm.

Water at a rate of 12 ml/m$^2$ was fed to the surface of the emulsion layer of each of the exposed light-sensitive elements by means of a wire bar coater. The layer surface thereof and the dye-fixing element were put upon each other so as to be brought into contact with each other.

The laminate was heated for 20 seconds by using heated rollers whose temperature was so controlled that the temperature of the layer which absorbed water became 90° C. The dye-fixing element was then peeled from the light-sensitive element. An image was obtained on the dye-fixing element.

Exposure was carried out by using the following three semiconductor lasers (hereinafter abbreviated to LD) and changing the quantity of light. Semiconductor Laser (1) AlGaInP (oscillating wavelength about 670 nm)
(2) GaAlAs (oscillating wavelength about 750 nm)
(3) GaAlAs (oscillating wavelength about 810 nm)

Thereafter, development was carried out under the same conditions as those described above.

TABLE 3

| Exposure method | 101 | Evaluation | 102 | Evaluation | 103 | Evaluation | 104 | Evaluation |
|---|---|---|---|---|---|---|---|---|
| | Hue of Image Obtained | | | | | | | |
| LED exposure: | | | | | | | | |
| 570 nm | yellow | ○ | yellow | ○ | yellow | ○ | yellow | ○ |
| 670 nm | magenta | ○ | reddish magenta | ○ | magenta | ○ | magenta | ○ |
| 810 nm | cyan | ○ | cyan | ○ | cyan | ○ | yellowish green | x |
| LD exposure: | | | | | | | | |
| 670 nm | magenta | ○ | magenta | ○ | magenta | ○ | magenta | ○ |
| 750 nm | — | | yellow | ○ | yellow | ○ | yellow | ○ |
| 810 nm | cyan | ○ | cyan | ○ | cyan | ○ | yellowish green | x |

It is apparent from the above Table 3 that two light sources for exposure can be effectively used for the light-sensitive materials of the present invention, In the light-sensitive element 102, yellow is mixed with magenta and hence the deterioration of hue is practically unobtrusive, The following evaluation was made for the evaluation of the color separation, Density was measured with a status A filter by X-RITE, The density obtained by subtracting the density of the support from the measured value was referred to as the standard, The degree of color mixture was represented by a percentage, The evaluation of the color mixture was made at a point at which the refection density of a color (which was the primary color) was 1.5 to 1.7.

| | Magenta Color Mixing Ratio and Evaluation | | | Yellow Color Mixing Ratio and Evaluation | | |
|---|---|---|---|---|---|---|
| | ○ | Δ | x | ○ | Δ | x |
| Cyan Density 1.5 to 1.7 | 40% or lower | 40 to 60% | 60% or higher | 30% or lower | 30 to 45% | 45% or higher |

| | Yellow Color Mixing Ratio and Evaluation | | | Cyan Color Mixing Ratio and Evaluation | | |
|---|---|---|---|---|---|---|
| | ○ | Δ | x | ○ | Δ | x |
| Magenta Density 1.5 to 1.7 | 40% or lower | 40 to 60% | 60% or higher | 15% or lower | 15 to 30% | 30% or higher |

-continued

| | Magenta Color Mixing Ratio and Evaluation | | | Cyan Color Mixing Ratio and Evaluation | | |
|---|---|---|---|---|---|---|
| | ○ | Δ | x | ○ | Δ | x |
| Yellow Density 1.5 to 1.7 | 40% or lower | 40 to 60% | 60% or higher | 10% or lower | 10 to 20% | 20% or higher |

EXAMPLE 2

The gelatin dispersion of the dye-providing compound will be illustrated below.

| | Yellow (g) | Magenta (g) | Cyan (g) |
|---|---|---|---|
| Dye-providing compound | (1) 13 | (2) 19.2 | (3) 16.6 |
| Electron donor (1) | 10.0 | 8.3 | 7.9 |
| High-boiling solvent (2) | 6.5 | 9.6 | 8.3 |
| Electron transferring agent precursor (3) | 0.5 | 0.8 | 0.8 |

Each of the above-described yellow, magenta and cyan formulations was added to 50 ml of ethyl acetate and dissolved therein by heating them at about 60° C. to form a uniform solution. One hundred g of a 10% aqueous solution of lime-processed gelatin, 0.6 g of sodium dodecylbenzenesulfonate and 50 ml of water were mixed with the above solution by stirring. The mixture was dispersed in a homogenizer at 10,000 rpm for 10 minutes. The resulting dispersion is referred to as the gelatin dispersion of dye-providing compound.

The compounds listed above are described in greater detail below:

Yellow dye-providing compound (1)

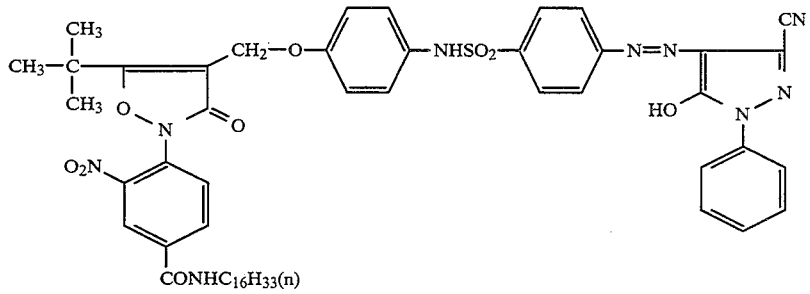

Magenta dye-providing compound (2)

-continued

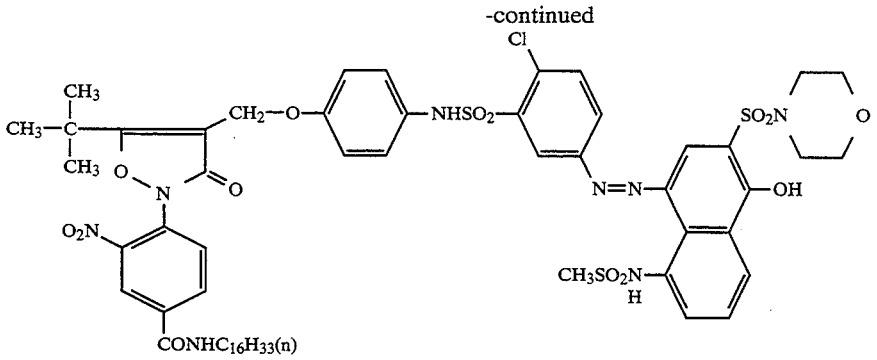

Cyan dye-providing compound (3)

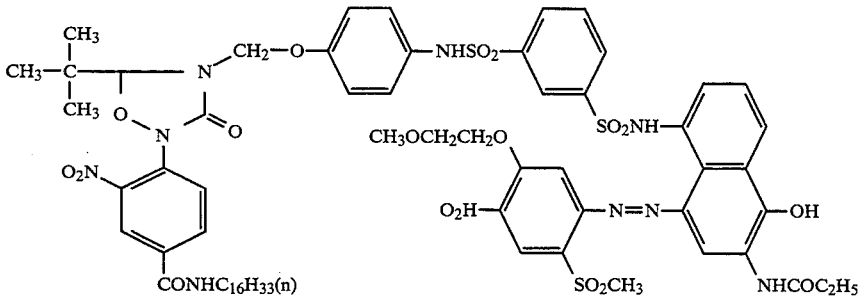

Electron donor (1)

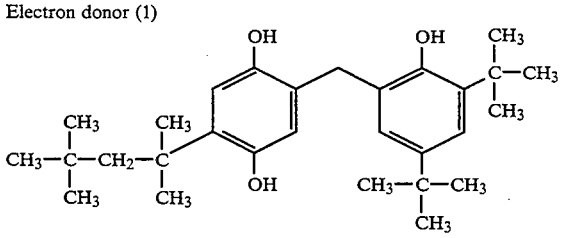

High-boiling solvent (2)

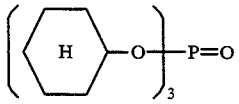

Electron transferring agent precursor (3)

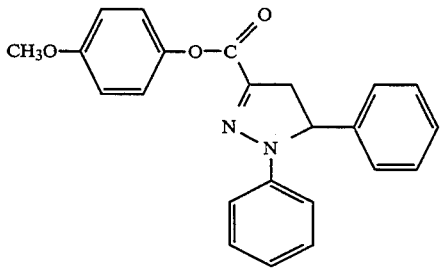

The gelatin dispersion of electron donor (4) for use in the interlayer will be illustrated below.

23.6 g of electron donor (4) and 8.5 g of the above-described high-boiling solvent (2) were dissolved in 30 ml of ethyl acetate to prepare a uniform solution. One hundred g of a 10% aqueous solution of lime-processed gelatin, 0.3 g of sodium dodecylbenzenesulfonate and 30 ml of water were mixed with the above solution with stirring. The mixture was dispersed in a homogenizer at 10,000 rpm for 10 minutes. The resulting dispersion is referred to as the gelatin dispersion of electron donor (4).

Electron donor (4)

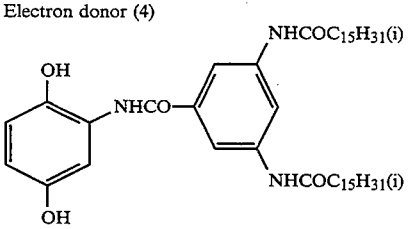

The light-sensitive silver halide emulsion (I) was prepared in the following manner.

Twenty g of gelatin, 3 g of potassium bromide and 0.3 g of $HO(CH_2)_2S(CH_2)_2S(CH_2)_2OH$ were added to 800 ml of water, and the resulting aqueous gelatin solution was kept at 60° C. by stirring. To the stirred aqueous gelatin solution, there were added simultaneously the following solutions I and II over a period of 30 minutes. Thereafter, the following solutions III and IV were simultaneously added thereto over a period of 20 minutes. After the completion of the addition, 30 ml of a 1% aqueous solution of potassium iodide was added thereto. Further, the following dye solution was added thereto. After water washing and desalting, 20 g of lime-processed ossein gelatin added thereto to adjust the pH to 6.2 and the pAg to 8.5. Sodium thiosulfate, 4-hydroxy-6-methyl-1,3,3a,7-tetrazaindene and chloroauric acid were added thereto to effect thereby the optimum chemical sensitization. In this way, 600 g of a monodisperse octahedral silver iodobromide emulsion having a mean grain size of 0.45 μm was obtained.

| | Solution I (180 ml by adding water) | Solution II 180 ml by adding water) | Solution III (350 ml by adding water) | Solution IV (350 ml by adding water) |
|---|---|---|---|---|
| $AgNO_3$ | 30 g | — | 70 g | — |
| KBr | — | 20 g | — | 49 g |
| KI | — | 1.8 g | — | — |

Dye solution

A solution of 0.14 g of the following dye dissolved in 70 ml of methanol.

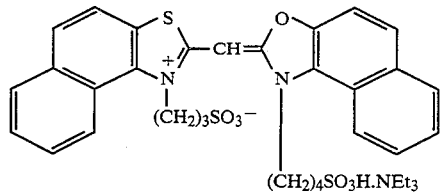

The light-sensitive silver halide emulsion (II) was prepared in the following manner.

Twenty g of gelatin, 0.30 g of potassium bromide, 6 g of sodium chloride and 0.015 g of the following reagent A were added to 730 ml of water, and the resulting aqueous gelatin solution was kept at 60.0° C. by stirring. To the stirred aqueous gelatin solution, there were simultaneously added the following solutions I and II at an equal flow rate over a period of 60 minutes. After the completion of the addition of solutions I and II, a methanol solution III of sensitizing dye (C) was added thereto. In this way, a monodisperse cubic emulsion having a mean grain size of 0.45 μm and containing the dye adsorbed thereon was obtained.

After water washing and desalting, 20 g of gelatin was added thereto. The pH was adjusted to 6.4 and the pAg was adjusted to 7.8. Chemical sensitization was then carried out at 60.0° C. The reagents used were 1.6 mg of triethylthiourea and 100 mg of 4-hydroxy-6-methyl-1,3,3a,7-tetrazaindene, and ripening time was 55 minutes. The yield of the emulsion was 635 g.

Reagent A

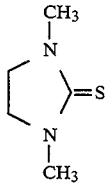

Sensitizing dye (C)

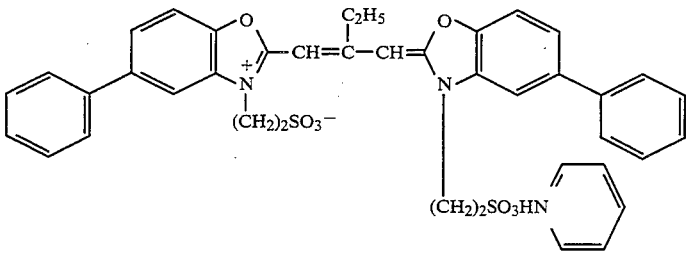

| | Solution I (total volume of 400 ml by adding water) | Solution II (total volume of 400 ml by adding water) | Solution III (total volume of 77 ml by adding methanol) |
|---|---|---|---|
| $AgNO_3$ | 100.0 g | — | — |
| KBr | — | 56.0 g | — |
| NaCl | — | 7.2 g | — |
| Sensitizing dye A* | — | — | 0.20 g |
| Sensitizing dye (C) | — | — | 0.23 g |

*Sensitizing dye A of Example 1.

The light-sensitive silver halide emulsion (III) was prepared in the following manner.

Twenty g of gelatin, 1 g of potassium bromide and 0.35 g of $OH(CH_2)_2S(CH_2)_2OH$ were added to 800 ml of water, and the resulting aqueous gelatin solution was kept at 35° C. by stirring. To the stirred aqueous gelatin solution, there were simultaneously added the following solutions I, II and[III at an equal flow rate over a period of 30 minutes. In this way, a monodisperse silver bromide emulsion having a mean grain size of 0.35 μm and containing the dye adsorbed thereon was prepared.

After water washing and desalting, 20 g of lime-processed ossein gelatin was added thereto. The pH was adjusted to 6.4 and the pAg was adjusted to 8.2. The emulsion was kept at 60° C. Nine mg of sodium thiosulfate, 6 ml of a 0.01% aqueous solution of chloroauric acid and 190 mg of 4-hydroxy-6-methyl-1,3,3a,7-tetrazaindene were added thereto. Chemical sensitization was carried out for 45 minutes. The yield of the emulsion was 635 g.

| | Solution I (total volume of 450 ml by adding water) | Solution II (total volume of 400 ml by adding water) | Solution III (total volume of 60 ml by adding methanol) |
|---|---|---|---|
| $AgNO_3$ | 100 g | — | — |
| KBr | — | 70 g | — |
| Dye (B)* | — | — | 120 mg |

*sensitizing dye (B) of Example 1

The following light-sensitive element 105 was prepared by using the thus-obtained emulsions.

TABLE 4

| Layer No. | Function | Additive | Coating Weight ($mg/m^2$) |
|---|---|---|---|
| Sixth layer | Protective layer | gelatin | 900 |
| | | silica (size: 4 μm) | 40 |
| | | zinc hydroxide | 600 |
| | | surfactant (5) | 130 |
| Fifth layer | blue-sensitive emulsion layer | light-sensitive silver halide emulsion (I) (in terms of silver) | 380 |
| | | yellow dye-providing compound (1) | 400 |
| | | gelatin | 600 |
| | | electron donor (1) | 308 |
| | | high-boiling solvent (2) | 200 |
| | | electron transferring agent precursor (3) | 15 |
| | | zinc hydroxide | 330 |
| | | anti-fogging agent (6) | 0.6 |
| Fourth layer | inter-layer | gelatin | 700 |
| | | electron donor (4) | 130 |
| | | high-boiling solvent (2) | 48 |
| | | surfactant (7) | 61 |
| | | electron transferring agent (8) | 36 |
| | | electron transferring agent (9) | 27 |
| | | hardening agent (10) | 37 |
| Third layer | green-sensitive emulsion layer | light-sensitive silver halide emulsion (II) (in terms of silver) | 220 |
| | | magenta dye-providing compound (2) | 365 |
| | | gelatin | 310 |
| | | electron donor (1) | 158 |
| | | high-boiling solvent (2) | 183 |
| Third layer | green-sensitive emulsion layer | electron transferring agent precursor (3) | 15 |
| | | electron transferring agent (8) | 27 |
| | | anti-fogging agent (11) | 0.8 |
| Second layer | inter-layer | gelatin | 790 |
| | | zinc hydroxide | 300 |

TABLE 4-continued

| | | | |
|---|---|---|---|
| | | electron donor (4) | 130 |
| | | high-boiling solvent (2) | 73 |
| | | water-insoluble dye S-1 of invention | 50 |
| | | surfactant (7) | 100 |
| | | activated carbon (size: 0.2 μm) | 25 |
| First layer | red-sensitive emulsion layer | light-sensitive silver halide emulsion (III) (in terms of silver) | 230 |
| | | cyan dye-providing compound (3) | 343 |
| | | gelatin | 330 |
| | | electron donor (1) | 163 |
| | | high-boiling solvent (2) | 172 |
| | | electron transferring agent precursor (3) | 17 |
| | | electron transferring agent (8) | 28 |
| | | anti-fogging agent (12) | 0.7 |
| Support polyethylene terephthalate of 96 μm (carbon black was coated on the backing layer) | | | |

Anti-fogging agent (6)

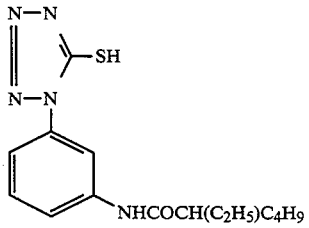

Surfactant (7)

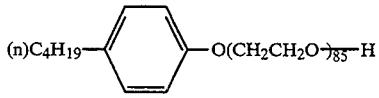

Electron transferring agent (8)

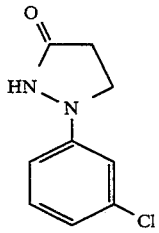

Electron transferring agent (9)

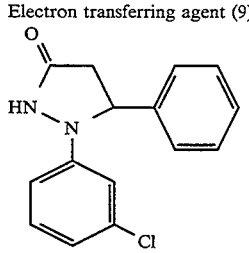

Hardening agent (10)

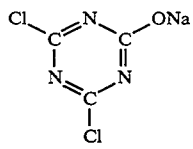

Anti-fogging agent (11)

TABLE 4-continued

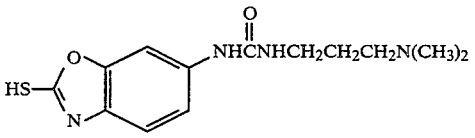

Anti-fogging agent (12)

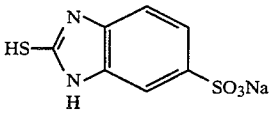

An emulsion for the fifth layer Was prepared in the same way as in the preparation of the emulsion for the fifth layer of the light-sensitive element 105 except that a methanol solution of 20 mg of a spectral sensitizing dye having sensitization wavelength in the region of 700 nm or above was added after 55 minutes of the ripening time in the preparation of the emulsion (I) as shown in Table 5.

The preparation of the dye-fixing element will be illustrated below.

The surface of a polyethylene-laminated paper support was coated with the following layers to prepare the dye-fixing element having the following structure.

| Structure of dye-fixing element | | |
|---|---|---|
| Layer No. | Additive | Amount ($g/m^2$) |
| Third layer | gelatin | 0.05 |
| | silicone oil*1 | 0.04 |
| | surfactant*2 | 0.001 |
| | surfactant*3 | 0.02 |
| | surfactant*4 | 0.10 |
| | picolinic acid guanidine | 0.54 |
| | polymer*5 | 0.24 |
| Second layer | mordant*6 | 2.35 |
| | polymer*7 | 0.60 |
| | gelatin | 1.40 |
| | polymer*5 | 0.21 |
| | high-boiling solvent*8 | 1.40 |
| | picolinic acid guanidine | 2.16 |
| | surfactant*2 | 0.02 |
| First layer | gelatin | 0.45 |
| | surfactant*4 | 0.01 |
| | polymer*5 | 0.04 |
| | hardening agent*9 | 0.30 |
| Polyethylene (containing 10 wt % $TiO_2$ dispersed therein) - laminated paper support (thickness: 170 μm) | | |
| First backing layer | gelatin | 3.25 |
| | hardening agent*9 | 0.25 |
| Second backing layer | gelatin | 0.44 |
| | silicone oil*1 | 0.08 |
| | surfactant*2 | 0.002 |
| | matting agent*10 | 0.09 |

Silicone oil*1

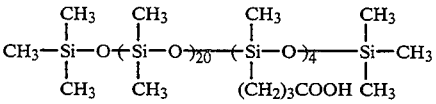

Surfactant*2 Aerosol OT

Surfactant*3

-continued $C_8F_{17}SO_2N(C_3H_7)CH_2COOK$

Surfactant*4

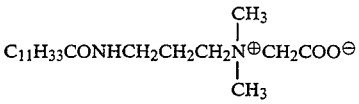

Polymer*5 Vinyl alcohol - sodium acrylate copolymer (75/25 molar ratio)

Polymer*7 Dextran (MW = 70,000)

Mordant*6

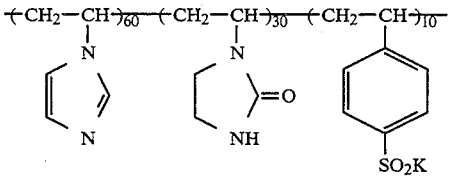

High-boiling organic solvent*

Leophos 95 (a product of Ajinomoto Co., Inc.)

Hardening agent*9

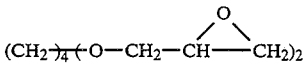

Matting agent*10 Benzoguanamine resin (average particle size: 10 μm)

TABLE 5

| Light-sensitive element | 105 | 106 | 107 | 108 |
|---|---|---|---|---|
| Spectral sensitizing dye added to emulsion (I) of the fifth layer (blue-sensitive layer) | omitted | I-2 | I-15 | II-1 |
| and maximum sensitization wavelength | — | 805 nm | 790 nm | 810 nm |
| Maximum sensitization wavelength of the third layer | 545 nm<br>570 nm | 545 nm<br>570 nm | 545 nm<br>570 nm | 545 nm<br>570 nm |
| Maximum sensitization wavelength of the first layer | 685 nm | 685 nm | 685 nm | 685 nm |
| | Comp. Ex. | Inven-tion | Inven-tion | Inven-tion |

These light-sensitive elements were exposed by using three color filters of SP-1 (blue), SP-2 (green) and SP-3 (red) and infrared cut filter.

Each of the exposed light-sensitive elements was immersed in water kept at 35° C. for 5 seconds and squeezed by means of rollers. Immediately thereafter, the layer surface thereof and the dye fixing element were put upon each other so as to be brought into contact with each other. The resulting laminate was heated for 15 seconds by using a heating drum whose temperature was controlled that the temperature of water supplied became about 80° C. When the dye-fixing element was peeled off from the light-sensitive element, there was an image thereon.

In the same way as in Example 1, exposure was carried out by using a color printer Pictrography manufactured by Fuji Photo Film Co., Ltd. Thereafter, water coating and heat treatment were carried out in the same manner as that described above.

The results are shown in Table 6.

TABLE 6

| Exposure Method | Hue of image obtained 105 | Evaluation | 106 | Evaluation | 107 | Evaluation | 108 | Evaluation |
|---|---|---|---|---|---|---|---|---|
| LED Exposure | | | | | | | | |
| 570 nm | green | ○ | green | ○ | green | ○ | green | ○ |
| 670 nm | red | ○ | red | ○ | red | ○ | red | ○ |
| 810 nm | — | blue | ○ | blue | ○ | blue | ○ | |
| Filter Exposure | | | | | | | | |
| SP-1 | blue | ○ | blue | ○ | blue | ○ | blue | ○ |
| SP-2 | green | ○ | green | ○ | green | ○ | green | ○ |
| SP-3 | red | ○ | red | ○ | red | ○ | red | ○ |

It is clear from Table that the light-sensitive materials of the present invention can be applied to two uses and are superior to the art.

Example 3

A light-sensitive element 201 was prepared in the same way as in the preparation of the light-sensitive element 101 given in Table 1 of Example 1 except that the sensitizing dye (I-5) in an amount of $5\times10^{-5}$g/m$^2$ was added to the fifth layer to form the yellowish green-sensitive layer.

All of the emulsions, the organic silver salts and the gelatin dispersions of dye-providing compounds which were used in the light-sensitive element 201 were prepared in the same way as in the preparation of those used in the light-sensitive element 101 of Example 1.

The dye-fixing element was prepared in the same way in Example 1.

One g of a water-insoluble dye and 8.0 g of high-boiling solvent (1) used in the light-sensitive element 101 of Example 1 were dissolved in 10 g of cyclohexanone. One hundred g of a 10% gelatin solution and 30 ml of a 5% aqueous solution of a surfactant were mixed with the above solution with stirring. The mixture was dispersed in a homogenizer at 10,000 rpm for 10 minutes.

The resulting dispersion is referred to as insoluble dye dispersion.

The dispersion was added to the second layer as shown in the following Table 7 to prepare each of the other light-sensitive elements. The layer structure and other additives are the same as those of the light-sensitive material 201 when they are specifically not described.

TABLE 7

| Light-sensitive material | 201 | 202 | 203 | 204 | 205 |
|---|---|---|---|---|---|
| Additives in the dispersion additionally to the second layer, amount added ($\times 10^{-2}$ g/m$^2$) | | | | | |
| Dye | omitted | omitted | S-22 | S-22 | S-3 |
| | | | 2 | 4 | 4 |
| Gelatin | | | 20 | 40 | 40 |
| Surfactant | | | 3 | 6 | 6 |
| High-boiling solvent | | | 16 | 32 | 32 |
| Maximum sensitization wavelength of the first layer | 810 nm | 810 nm | 810 nm | 810 nm | 810 nm |
| Amount added ($\times 10^{-5}$ g/m$^2$) | 5.0 | 1.5 | 5.0 | 5.0 | 5.0 |
| Total amount ($\times 10^{-4}$ g/m$^2$) of mercapto compounds added to the first layer | 4.0 | 5.5 | 4.0 | 4.0 | 4.0 |
| | Comp. Ex. | Comp. Ex. | Inven-tion | Inven-tion | Inven-tion |

In these light-sensitive elements, the fifth layer has a sensitivity peak in the yellowish green color region and the infrared region of 730 nm, the third layer has sensitivity peak in the red region of 680 nm and the first layer has sensitivity in the infrared region of 810 nm.

In the same way as in Example 1, exposure was conducted by using three LEDs. Heat development was carried out under the conditions described in Example 1 to obtain an image on the dye-fixing element.

In the same way as in Example 1, exposure was carried out by using three LDs and changing the quantity of light.

Thereafter, development was carried out under the same conditions as those described above.

The results are shown in Table 8.

TABLE 8

| Sample | LED Exposure 570 nm | 670 nm | 810 nm | LD Exposure 670 nm | 750 nm | 810 nm |
|---|---|---|---|---|---|---|
| 201: | | | | | | |
| Hue | yellow | magenta | cyan | magenta | yellowish green | cyan |
| Evaluation | ○ | ○ | ○ | ○ | x | ○ |
| Sensitivity | ○ | ○ | ○ | ○ | ○ | ○ |
| 202: | | | | | | |
| Hue | yellow | magenta | cyan | magenta | yellow | cyan |
| Evaluation | ○ | ○ | ○ | ○ | ○ | ○ |
| Sensitivity | ○ | ○ | x (about 1/3) | ○ | ○ | Δ (about 1/3) |
| 203: | | | | | | |
| Hue | yellow | magenta | cyan | magenta | slightly yellowish green | cyan |
| Evaluation | ○ | ○ | ○ | ○ | Δ | ○ |
| Sensitivity | ○ | ○ | ○ | ○ | ○ | ○ |
| 204: | | | | | | |

TABLE 8-continued

| Sample | LED Exposure 570 nm | LED Exposure 670 nm | LED Exposure 810 nm | LD Exposure 670 nm | LD Exposure 750 nm | LD Exposure 810 nm |
|---|---|---|---|---|---|---|
| Hue | yellow | magenta | cyan | magenta | yellow | cyan |
| Evaluation | ○ | ○ | ○ | ○ | ○ | ○ |
| Sensitivity | ○ | ○ | ○ | ○ | ○ | ○ |
| 205: | | | | | | |
| Hue | yellow | magenta | cyan | magenta | yellow | cyan |
| Evaluation | ○ | ○ | ○ | ○ | ○ | ○ |
| Sensitivity | ○ | ○ | ○ | ○ | ○ | ○ |

The evaluation of color separation was made in the same way as in Example 1.

In the light-sensitive element 201, sufficient color separation can not be effected when light of 750 nm emitted by semiconductor lase (LD) is used.

When light of 750 nm emitted by LD is used, color separation can be improved by changing the amounts of the spectral sensitizing dye and the mercapto compound added to the cyan layer (the first layer) and reducing sensitivity to about $\frac{1}{3}$ as in the light-sensitive element 202. However, sensitivity to light of 810 nm emitted by LED is poor. LD has higher output than that of LED. Hence, the level of sensitivity to LED is somewhat low.

In the light-sensitive element 203 of the present invention, the amount of the water-insoluble dye added is small and hence color separation is somewhat poor when light of 750 nm emitted by LD is used. However, sensitivity is high and it is superior to that of element 202.

In the light-sensitive elements 204 and 205 of the present invention, sensitivity as well as color separation are superior.

The sensitivity of each sample of this Example at 810 nm was higher than that of each sample of Example 1, because the amount of the mercapto compound added to the first layer was smaller than that of the mercapto compound in each sample of Example 1.

The dispersion of the water-insoluble dye S-22 in the same amount as that added to the element 204 was added to the first layer to prepare a light-sensitive element 206.

The element was exposed and developed under the conditions described above.

The sensitivity of the first layer was slightly lowered and was 80% of that of the light-sensitive element 204. Other performances were substantially equal to those of the element 204.

It is apparent that the present invention is superior in any case.

Example 4

The gelatin dispersions of dye-providing compounds, the gelatin dispersion of electron donor (4) for an interlayer and light-sensitive silver halide emulsions (I) and (III) were prepared in the same way as in Example 2.

Silver halide emulsion (II) was prepared in the same way as in Example 2 except that a solution [total volume of 77 ml by adding methanol to 0.23 g of sensitizing dye (C)] was used in place of the solution (III) used in Example 2.

A light-sensitive element 301 was prepared by using the above-described components in the same way as in the preparation of the light-sensitive element 105 having the structure given in Table 4 in Example 2 except that further the sensitizing dye (I-5) in an amount of 0.05 mg/m$^2$ was added to the fifth layer to form a blue and infrared-sensitive emulsion layer and the sensitizing dye (C) in an amount of 0.05 mg/m$^2$ was added to the third layer to form a green and infrared-sensitive emulsion layer.

The fifth layer of the light-sensitive element had a sensitivity peak in the blue region and the infrared region having the maximum spectral sensitization wavelength at 7230 nm.

Further, the third layer had spectral sensitivity in the green region and the infrared region having the maximum spectral sensitization wavelength at 810 nm in addition to a sensitivity to blue which is inherent in silver halide emulsion.

The water-insoluble dye dispersion of S-22 was prepared in the same way as in Example 3 and added to the fourth layer. The same amount as that used in the light-sensitive element 204 was added. The resulting element is referred to as light-sensitive element 302.

These light-sensitive materials were exposed in the same way as in Example 2. The exposed light-sensitive elements were subjected to water coating treatment and heat treatment in the same way as in Example 2.

Exposure to the semiconductor laser described in Example 3 was conducted. Thereafter, a water coating treatment and a heat treatment were carried out in a similar manner to that described above.

The results are shown in Table 9.

TABLE 9

| | Light-Sensitive Element 301 | | Light-Sensitive Element 302 | |
|---|---|---|---|---|
| Filter Exposure: | | | | |
| SP-1 | blue | ○ | blue | ○ |
| SP-2 | green | ○ | green | ○ |
| SP-3 | slightly bluish red | Δ | red | ○ |
| LD Exposure: | | | | |
| 670 nm | slightly bluish red | Δ | red | ○ |
| 750 nm | slightly cyanish blue | Δ | blue | ○ |
| 810 nm | green | ○ | green | ○ |

It is apparent from Table 9 that the light-sensitive material of the present invention has excellent color separation for both uses.

While the present invention has been described in detail and with reference to specific embodiments thereof, it is apparent to one skilled in the art that various changes and modifications can be made therein without departing from the spirit and the scope of the present invention.

What is claimed is:

1. A color light-sensitive silver halide material comprising a blue-sensitive layer, a green-sensitive layer and a red-sensitive layer or a green-to-yellow-sensitive layer, a red-sensitive layer and an infrared-sensitive layer provided on a support, each layer comprising a combination of at least a light-sensitive silver halide, a binder and a dye-providing compound, wherein at least one layer thereof has spectral sensitization peaks in at least two wavelength regions, said peaks in said at least two wavelength regions being at least 50 nm away from each other and at least one spectral sensitization peak thereof exists in the region of wavelength of 700 nm or above, with the proviso that when said blue-sensitive layer has said at least two spectral sensitization peaks, said blue-sensitive layer is spectrally sensitized with a blue region spectral sensitizing dye.

2. A color light-sensitive silver halide material as in claim 1, wherein when a blue-sensitive layer, a green-sensitive layer and a red-sensitive layer is-provided on a support, said blue-sensitive layer is spectral sensitized with a blue region-sensitizing dye, said blue-sensitive layer having a second spectral sensitization peak in the wavelength region of 700 nm or above and said second spectral sensitization peak is at least 50 nm away from a spectral sensitization peak of said red-sensitive layer.

3. A color light-sensitive silver halide material as in claim 1, wherein said material comprises a combination of a blue-sensitive layer, a green-sensitive layer and a red-sensitive layer, said green-sensitive layer having a second spectral sensitization peak in the wavelength region of 700 nm or above and said second spectral sensitization peak is at least 50 nm away from a spectral sensitization peak of the red-sensitive layer.

4. A color light-sensitive silver halide material as in claim 1, wherein said material comprises a combination of a blue-sensitive layer, a green-sensitive layer and a red-sensitive layer, said red-sensitive layer having a second spectral sensitization peak in the wavelength region of 700 nm or above and said second spectral sensitization peak is at least 50 nm away from another spectral sensitization peak of the red-sensitive layer.

5. A color light-sensitive silver halide material as in claim 1, wherein said material comprises a combination of a green to yellow sensitive layer, a red-sensitive layer and an infrared-sensitive layer, said green to yellow sensitive layer having a second spectral sensitization peak in the wavelength region of 700 nm or above and said spectral sensitization peak is at least 50 nm away from the spectral sensitization peak of the red-sensitive layer and that of the infrared-sensitive layer.

6. A color light-sensitive silver halide material as in claim 1, wherein said material comprises a combination of a green to yellow sensitive layer, a red-sensitive layer and an infrared-sensitive layer, said red-sensitive layer having a second spectral sensitization peak in the wavelength region of 700 nm or above and said spectral sensitization peak is at least 50 nm away from the original spectral sensitization peak of the red-sensitive layer and the spectral sensitization peak of the infrared-sensitive layer.

7. A color light-sensitive silver halide material as in claim 1, wherein said material comprises a combination of a green to yellow sensitive layer, a red-sensitive layer and an infrared-sensitive layer, said infrared-sensitive layer having two spectral sensitization peaks in the wavelength region of 700 nm or above, said peaks being at least 50 nm away from each other, and each of said spectral sensitization peaks is at least 50 nm away from the spectral sensitization peak of the red-sensitive layer.

8. A color light-sensitive silver halide material as in claim 1, wherein one of said at least two wavelength regions is the infrared region and the other of said at least two wavelength regions is selected from the red, green, yellow, or blue region.

9. A color light-sensitive silver halide material as in claim 8, wherein said other region is the red region.

10. A color light-sensitive silver halide material as in claim 8, wherein said other region is the green region.

11. A color light-sensitive silver halide as in claim 8, wherein said other region is the yellow region.

12. A color light-sensitive silver halide material as in claim 8, wherein said other region is the blue region.

13. A color light-sensitive silver halide material as in claim 2, wherein the blue-sensitive layer contains a yellow dye-providing compound.

14. A color light-sensitive silver halide material as in claim 3, wherein the green-sensitive layer contains a magenta dye-providing compound.

15. A color light-sensitive silver halide material as in claim 4, wherein the red sensitive layer contains a cyan dye-providing compound.

16. A color light-sensitive silver halide material as in claim 5, wherein the green to yellow sensitive: layer contains a yellow dye-providing compound.

17. A color light-sensitive silver halide material as in claim 6, wherein the red-sensitive layer contains a magenta dye-providing compound.

18. A color light-sensitive silver halide material as in claim 7, wherein the infrared-sensitive layer contains a cyan dye-providing compound.

19. A transfer type heat-developable color light-sensitive silver halide material comprising a blue-sensitive layer, a green-sensitive layer and a red-sensitive layer or a green-to-yellow-sensitive layer, a red-sensitive layer and an infrared-sensitive layer provided on a support, each layer comprising a combination of at least a light-sensitive silver halide, a hydrophilic binder and a dye-providing compound, wherein at least one layer thereof has spectral sensitization peaks in at least two wavelength regions, said peaks in said at least two wavelength regions are at least 50 nm away from each other, at least one spectral sensitization peak thereof exists in the wavelength region of 700 nm or above, and a layer containing a water-insoluble dye, With the proviso that when said blue-sensitive layer has said at least two spectral sensitization peaks, said blue-sensitive layer is spectrally sensitized with a blue region spectral sensitizing dye.

20. A transfer type heat-developable color light-sensitive silver halide material as in claim 19, wherein said dye-providing compound is a nondiffusible compound capable of forming or releasing a dye which can be diffused in the hydrophilic binder.

21. A transfer type heat-developable color light-sensitive silver halide material as in claim 19, wherein at least two of said blue,sensitive layer, green-sensitive layer and red-sensitive layer or said green-to-yellow-sensitive layer, red-sensitive layer, and infrared sensitive layer each has a spectral sensitization peak in the wavelength region of 700 nm or above, the spectral sensitization peaks in the wavelength region of 700 nm or above in said two or more light-sensitive layers are at least 30 nm away from one another, and at least one light-sensitive layer thereof has another spectral sensitization peak in the region of wavelength which is shorter by at least 50 nm than the spectral sensitization peak at 700 nm or above and is in the region of wavelength of 700 nm or below.

22. A transfer type heat-developable color light-sensitive silver halide material as in claim 20, wherein a light-sensitive layer (layer B) having a spectral sensitization peak in the infrared region of a shorter wavelength is positioned nearer to an intended light source than a light-sensitive layer (layer A) having spectral sensitization peak in the infrared region of a longer wavelength, and a water-insoluble dye having a maximum absorption wavelength in a wavelength region capable of absorbing light emitted from the intended light source with a spectral sensitization peak wavelength in the infrared region of the layer B, is incorporated in layer A or between layers A and B.

23. A transfer type heat-developable color light-sensitive silver halide material as in claim 19, wherein said material comprises a combination of a green to yellow sensitive layer, a red-sensitive layer and an infrared-sensitive layer, said green to yellow sensitive layer having a second spectral sensitization peak in the wavelength region of 700 nm or above and said second spectral sensitization peak is at least 30 nm away from the spectral sensitization peak of the red-sensitive layer and that of the infrared-sensitive layer.

24. A transfer type heat-developing color light-sensitive material silver halide as in claim 19, wherein said material comprises a combination of a green to yellow sensitive layer, a red-sensitive layer and an infrared-sensitive layer, said red-sensitive layer having a second spectral sensitization peak in the wavelength region of 700 nm or above and said second spectral sensitization peak is at least 30 nm away from the original spectral sensitization peak of the red-sensitive layer and the spectral sensitization peak of the infrared-sensitive layer.

25. A transfer type heat-developing color light-sensitive silver halide material as in claim 19, wherein said material comprises a combination of a blue-sensitive layer, a green-sensitive layer and a red-sensitive layer, and two layers thereof have a second spectral sensitization peak in the wavelength region of 700 nm or above.

26. A transfer type heat-developable color light-sensitive silver halide material as in claim 19, wherein one of said at least two wavelength regions is the infrared region and the other of said at least two wavelength regions is selected from the red, green, yellow, or blue region.

27. A transfer type heat-developable color light-sensitive silver halide material as in claim 26, wherein said other region is the red region.

28. A transfer type heat-developable color light-sensitive silver halide material as in claim 26, wherein said other region is the green region.

29. A transfer type heat-developable color light-sensitive silver halide material as in claim 26, wherein said other region is the yellow region.

30. A transfer type heat-developable color light-sensitive material silver halide as in claim 26, wherein said other region is the blue region.

* * * * *